US005564690A

United States Patent [19]

Oshida

[11] Patent Number: 5,564,690

[45] Date of Patent: Oct. 15, 1996

[54] SHEET SUPPLY APPARATUS

[75] Inventor: Haruhisa Oshida, Hatogaya, Japan

[73] Assignee: Canon Kabushiki Kaisha, Tokyo, Japan

[21] Appl. No.: 483,550

[22] Filed: Jun. 7, 1995

Related U.S. Application Data

[63] Continuation of Ser. No. 79,894, Jun. 22, 1993, abandoned.

[30] Foreign Application Priority Data

Jun. 24, 1992 [JP] Japan ..... 4-189971
Jun. 26, 1992 [JP] Japan ..... 4-193112

[51] Int. Cl.[6] ..... B65H 1/26

[52] U.S. Cl. ..... 271/157; 271/127; 271/160; 271/164

[58] Field of Search ..... 271/145, 147, 271/157, 160, 162, 164, 127

[56] References Cited

U.S. PATENT DOCUMENTS

| | | | |
|---|---|---|---|
| 4,269,407 | 5/1981 | Tsuda et al. | 271/160 |
| 4,280,692 | 7/1981 | Hutchinson et al. | 271/160 |
| 5,078,380 | 1/1992 | Kitazawa | 271/164 |
| 5,222,725 | 6/1993 | Kasahara et al. | 271/127 |

FOREIGN PATENT DOCUMENTS

| | | | |
|---|---|---|---|
| 2929117A1 | 1/1980 | Germany . | |
| 52-053255 | 4/1977 | Japan . | |
| 52-53225 | 12/1977 | Japan . | |
| 2295828 | 12/1990 | Japan . | |
| 440260542 | 9/1992 | Japan | 271/147 |
| 2019366A | 10/1979 | United Kingdom . | |

*Primary Examiner*—H. Grant Skaggs
*Attorney, Agent, or Firm*—Fitzpatrick, Cella, Harper & Scinto

[57] ABSTRACT

The present invention provides a sheet supplying apparatus including a sheet cassette removably mountable to the sheet supply apparatus and having a rockable sheet support plate for supporting sheets, and a biasing device for biasing the sheet support plate toward a sheet supply device of the sheet supplying apparatus for feeding out the sheets; a locking device for locking the sheet support plate at a position spaced apart from the sheet supply device in opposition to a biasing force of the biasing means; a releasing device for releasing a locking condition of the locking device when the sheet cassette is mounted to the sheet supplying apparatus; and a buffer device for reducing a shifting speed of the sheet support plate effected by the biasing device when the locking condition of the locking device is released by the releasing device. The present invention further provides an image forming apparatus including such sheet supplying apparatus.

32 Claims, 14 Drawing Sheets

SHEET SUPPLY APPARATUS

This application is a continuation of application Ser. No. 08/079,894, filed Jun. 22, 1993, now abandoned.

BACKGROUND OF THE INVENTION

1. Field of the Invention

The present invention relates to a sheet supplying apparatus used with an image forming apparatus such as a copying machine, a printer, a facsimile machine and the like.

2. Related Background Art

In general, in a sheet supplying apparatus for an image forming apparatus such as a copying machine and the like, a plurality of sheets such as transfer sheets, photosensitive sheets or the like is stacked on a sheet stacking plate (movable plate) 101 in a sheet supply cassette 100 as shown in FIG. 24, and the sheets are supplied from the sheet stacking plate 101 and are separated one by one by a sheet supply means such as a sheet supply roller to be fed to a next station.

However, in such a sheet supplying apparatus, in the sheet supply cassette 100 acting as a sheet containing portion, a free end portion of the sheet stacking plate 101, normally biased upwardly by a biasing spring 102, or a front end portion of the sheet stack rested on the sheet stacking plate 101, is pushed upwardly toward an uppermost position so that the sheet stack is abutted against the separating claws 103 or the sheet supply means stably. Accordingly, the replenishment of new sheets into the cassette 100 must be effected while pushing down the sheet stack plate 101 in opposition to the biasing force of the biasing spring 102 and keeping the front ends of the sheets from a separation means and the sheet supply means, thereby worsening the workability of the replenishing operation.

To eliminate such inconvenience, recently, a sheet supplying apparatus as shown in FIG. 25 has been proposed (refer to the Japanese Utility Model Publication No. 52-53225).

In this sheet supply apparatus, a cassette 105 is provided with a locking means 109 (comprising a pin 110 formed on a sheet stacking plate 106 and a lock lever 112 attached to a side plate 111 of the cassette 105) for locking the sheet stacking plate 106 at a predetermined position when the sheet stacking plate 106 is pushed down in opposition to a biasing spring 107. After the sheets are replenished into the cassette 105, when the cassette 105 is mounted to an image forming apparatus (not shown), the lock of locking means 109 (locking lever 112) is released by a releasing means 113 of the image forming apparatus. When the cassette is mounted to the image forming apparatus, the releasing means 113 drives the lock lever 112 in a counterclockwise direction, thereby releasing the lock lever 112 from the pin 110.

Incidentally, in FIG. 25, the reference numeral 106A denotes a pivot pin for the sheet stacking plate 106; 112A denotes a pivot pin for the lock lever 112; 115 denotes a biasing spring for the lock lever 112; 116 denotes a separating claw; and 117 denotes a sheet supply roller.

However, in the above-mentioned sheet supplying apparatus (FIG. 25), as the cassette 105 is mounted to the image forming apparatus, when the locking means 109 is released by the releasing means 113, the sheet stacking plate 106 suddenly spring back by the action of the biasing spring 107, thereby frightening the operator, causing damage of the sheets from collision between the sheets and the separation means 117 and/or the sheet supply means 117 and from the jamming of the sheets due to the deviation of the stacking position, and causing trouble in the image forming apparatus due to the shock to the image forming apparatus. This is noticeable particularly when the cassette 105 containing a small amount of sheets in comparison with the capacity of the cassette is mounted to the image forming apparatus, as in the case where jam treatment is effected or a small amount of sheets having low frequency of use are used temporarily.

SUMMARY OF THE INVENTION

The present invention is intended to eliminate the above-mentioned conventional drawbacks, and has an object to provide a sheet supplying apparatus which can suppress the sudden lifting of a sheet stacking plate when a locking means for locking a sheet stacking plate at a predetermined position is released by a releasing means.

The present invention relates to a sheet supplying apparatus comprising a sheet supply cassette having a sheet support plate for stacking sheets and a biasing means for biasing the sheet support plate toward a sheet supply means, a locking means for locking the sheet supply plate at a predetermined position when the sheet support plate is pushed down in opposition to a biasing force of the biasing means, and a releasing means for releasing the engagement condition between the sheet support plate and the locking means when the cassette is mounted to an image forming apparatus.

The present invention is characterized in a buffer means for relieving the abrupt lifting movement of the sheet support plate when the engagement condition between the sheet support plate and the locking means is released by the releasing means.

With the arrangement mentioned above, when the engagement condition between the sheet support plate and the locking means is released and the sheet support plate is abruptly lifted by the action of the biasing means, the abrupt lifting movement of the sheet support plate is suppressed by the buffer means. Consequently, the collision between the sheets and a separation means and/or the sheet supply means is relieved, thereby preventing damage of the sheets and sheet jam due to the deviation of the stacking position.

DETAILED DESCRIPTION OF THE PREFERRED EMBODIMENTS

The present invention will now be explained in connection with embodiments thereof with reference to the accompanying drawings.

Figure 1:
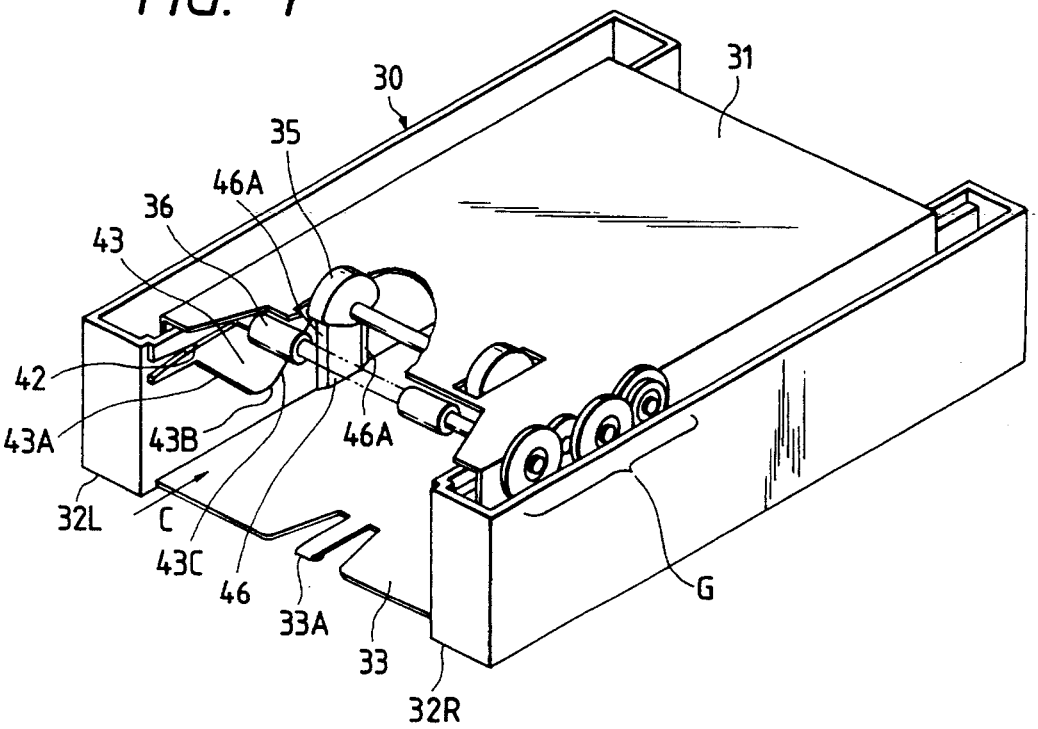
FIG. 1 is a perspective view of a sheet feeder as a sheet supplying apparatus according to a first embodiment of the present invention.
Figure 2:
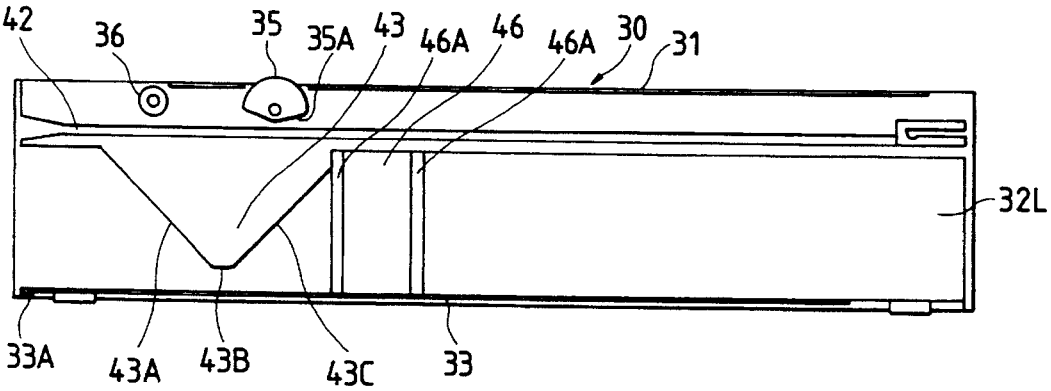
FIG. 2 is an elevational sectional view of the sheet feeder of FIG. 1.
Figure 3:
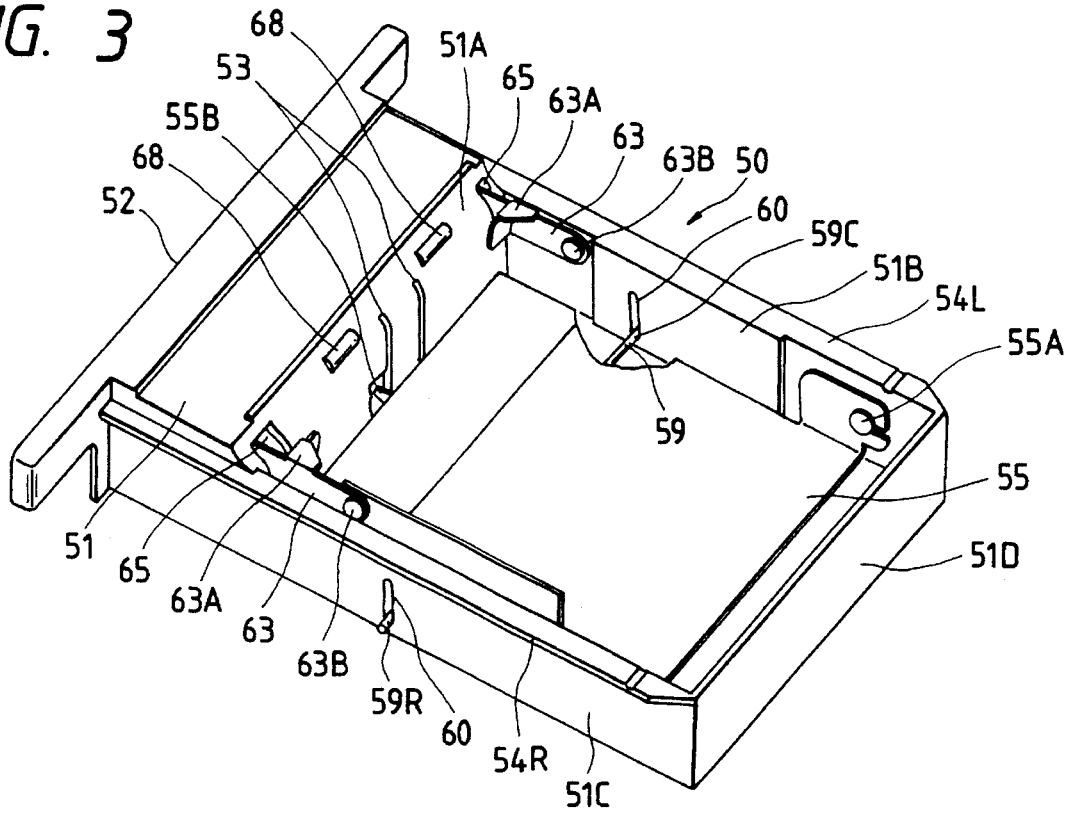
FIG. 3 is a perspective view of a sheet cassette to be mounted to the sheet feeder of FIG. 1.
Figure 4:
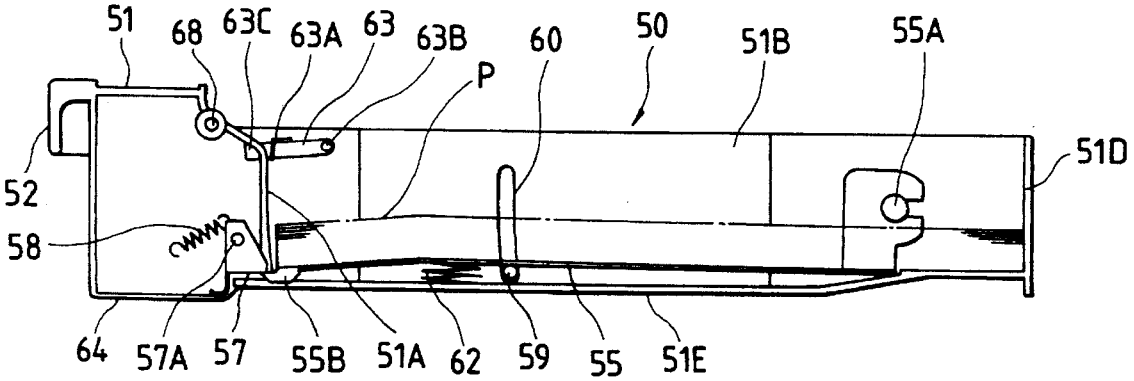
FIG. 4 is an elevational sectional view of the sheet cassette of FIG. 3.

FIGS. 1 and 2 show the whole construction of a sheet feeder (apparatus body) of a sheet supplying apparatus according to a first embodiment of the present invention, and FIGS. 3 and 4 show the whole construction of a sheet cassette of the sheet supplying apparatus.

First of all, the sheet feeder 30 will be described with reference to FIGS. 1 and 2. In FIGS. 1 and 2, the reference numeral 31 denotes an upper plate of the feeder; 32L, 32R denote elongated supports extending in a front-and-rear direction and attached to left and right sides of the upper plate 31 in parallel with each other; and 33 denotes a lower plate of the feeder. The lower plate 33 is provided at its front end with a lock releasing tab 33A.

A sheet cassette accommodating space C (FIG. 1) is defined by a lower surface of the upper plate 31, an upper surface of the lower plate 33 and inner surfaces of the left and right elongated supports 32L, 32R.

The reference numeral 35 denotes a sheet supply roller; and 36 denotes a sheet feed roller. The sheet supply roller comprises D-cut roller portions each having a semi-circular cross-section. The sheet supply roller 35 is positioned substantially in parallel with the sheet feed roller 36. The sheet feed roller 36 is arranged near the front end of the upper plate 31 and the sheet supply roller 35 is arranged at an upstream side of the sheet feed roller in a sheet supplying direction.

The reference numeral 42 denotes sheet cassette guide grooves (only one of which is shown) symmetrically formed in the inner surfaces of the left and right elongated supports 32L, 32R along their lengths; and 43 denotes cams (only one of which is shown) symmetrically formed in the inner surface of the left and right elongated supports 32L, 32R and each having a front inclined portion 43A, a horizontal portion 43B and a rear inclined portion 43C. The reference numeral 46 denotes friction members (only one of which is shown) symmetrically protruding from the inner surfaces of the left and right elongated supports 32L, 32R and disposed rearwardly of the cams 43. Each friction member 46 is provided at its front and rear with inclined surfaces 46A, respectively, which inclined surfaces are smoothly contiguous to the inner surface of the elongated support 32L, 32R. Incidentally, in FIG. 1, the symbol G denotes a gear train for transmitting a rotational force to the sheet supply roller 35 and the sheet feed roller 36.

Next, the sheet cassette 50 will be explained with reference to FIGS. 3 and 4.

In FIGS. 3 and 4, the reference numeral 51 denotes a parallelepiped cassette body case having an open top; and 51A, 51B, 51C, 51D, 51E denote a front wall, a left side wall, a right side wall, a rear wall and a bottom wall of the case 51, respectively. The reference numeral 52 denotes a gripper portion formed on a front end of the cassette body case 51; and 54L, 54R denote elongated flanges extending longitudinally of the left and right side walls 51B, 51C of the case 51 and protruding outwardly from top ends of the side walls, respectively.

A movable plate (sheet support plate) 55 is housed in the cassette body case 51. The sheet support plate has a rear end portion pivotally mounted around pivot pins 55A and is biased upwardly by an urging spring (biasing means) 62. The movable sheet support plate 55 is provided at its front end with plate lock portions 55B. The plate lock portions 55B are protruded from the front wall 51A of the cassette body case 51 through locking slots 53 formed in the front wall 51A. Sheets P are contained in the cassette body case 51 while being stacked on the movable sheet support plate 55. A push-down rod 59 engaged by the movable sheet support plate 55 has left and right ends 59L, 59R received in inclined slots 60 symmetrically formed in the left and right side walls 51B, 51C of the cassette body case 51, which left and right ends 59L, 59R protrude from the left and right side walls 51B, 51C outwardly. Both ends of the push-down rod 59 have substantially spherical surfaces.

The reference numeral 63 denotes separating claw levers provided on the left and right side walls 51B, 51C of the cassette body case 51; and 63A denotes a separating claws. Each separating claw lever 63 has a rear end portion pivotally mounted on a pivot pin 63B and a front end portion 63C received in an opening 65 formed in the front wall 51A of the cassette body case 51. The reference numeral 68 denotes sheet convey rollers.

Figure 5:
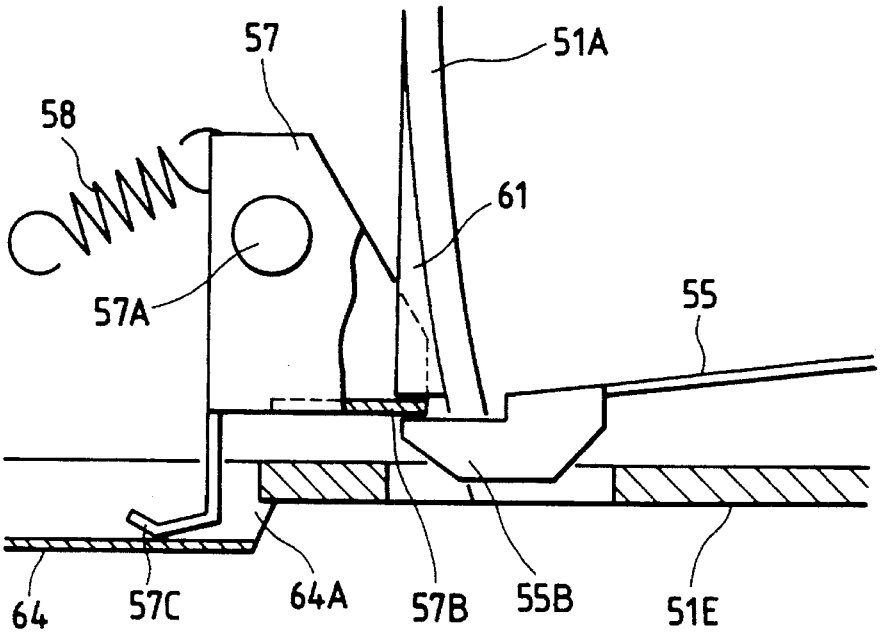
FIG. 5 is a sectional view showing a locking portion of a sheet support plate in sheet cassette of FIG. 3.

FIG. 5 shows a lock portion (latch means) of the movable sheet support plate 55 in detail.

The reference numeral 57 denotes a lock pawl for holding the movable support plate 55 at a predetermined position; and 61 denotes a rib formed on an outer surface of the front wall 51A of the cassette body case 51 and disposed between the locking slots 53 formed in the front wall 51A. The lock pawl 57 is biased by a tension spring 58 for rotation in an a counterclockwise direction around a pivot shaft 57A disposed in front end of the movable sheet support plate 55, so that a free end 57B of the lock pawl 57 is abutted against the rib 61 from below to regulate the lock pawl.

The movable support plate 55 is held at the predetermined position by abutting the locking portions 55B protruding outwardly from the front wall 51A of the cassette body case 51 against the free end 57B of the lock pawl 57 from below. On the other hand, a lock releasing arm 57C protrudes from the bottom wall 51E downwardly and is covered by a protection cover 64 provided on the bottom wall 51E.

The protection cover 64 is provided at its rear with an opening 64A through which the lock releasing tab (releasing means) 33A formed on the lower plate 33 of the feeder is inserted.

Figure 6:
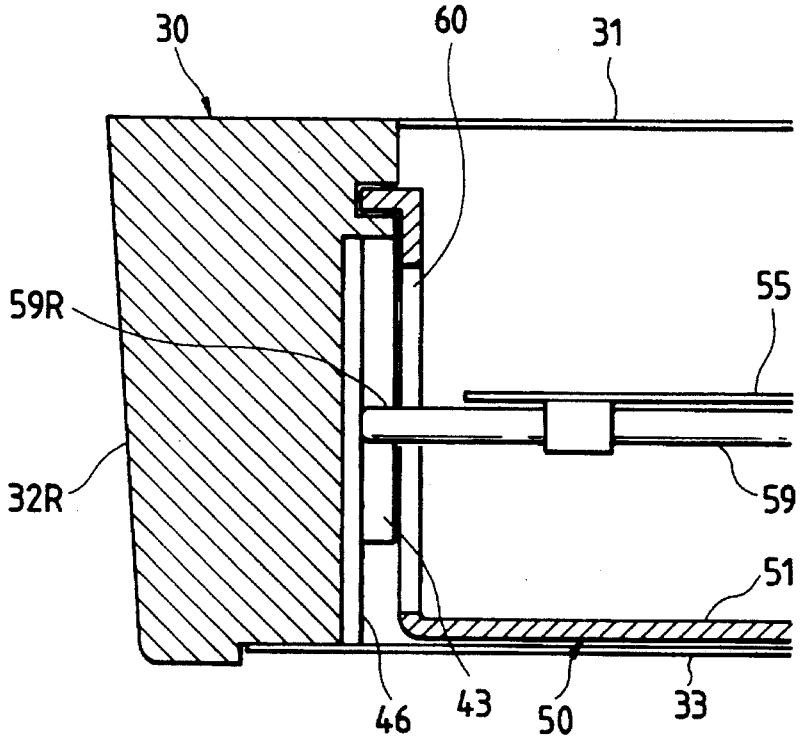
FIG. 6 is a sectional view showing a positional relation between friction members when the sheet cassette is mounted to the sheet feeder.

FIG. 6 shows the positional relation between the push-down rod 59 of the sheet cassette 50 and the cams 43 and the friction members 46 of the feeder 30. Both end portions 59L, 59R (only one of which is shown) of the push-down rod 59 are engaged by the cams 43 at their peripheral surfaces and are slidingly abutted against the friction members 46 at their spherical end faces.

FIGS. 7 to 10 show continuous movements of main elements when the sheet cassette 50 is dismounted from the sheet feeder 30.

In a condition that the sheet cassette 50 is mounted to the sheet feeder 30, the push-down rod 59 is spaced apart from the cams 43. The movable support plate 55 is lifted upwardly by the urging spring 62 so that the front corners of the sheet stack or the support plate 55 are abutted against the separating claws 63A. On the other hand, the lock releasing arm 57C is abutted against the lock releasing tab 33A formed on the lower plate 33 of the feeder 30, thereby holding the lock pawl 57 in a retracted position (condition shown in FIG. 7).

Figure 7:
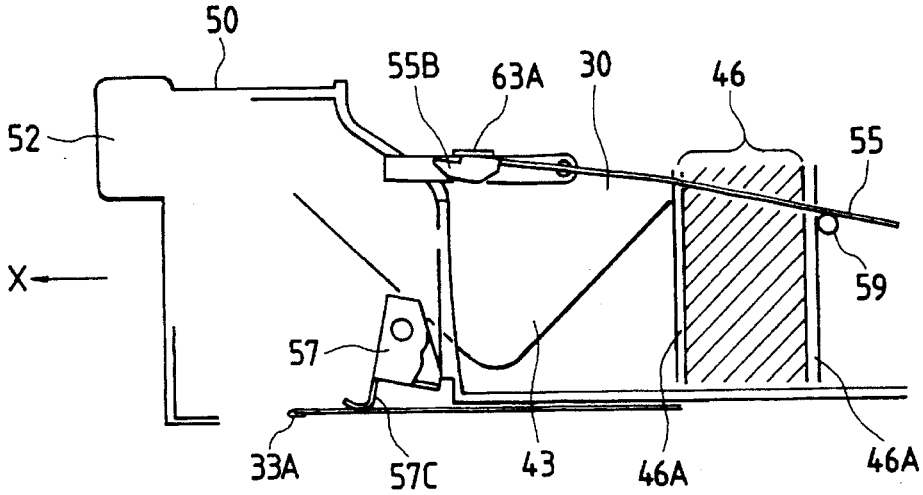
FIGS. 7 to 10 are elevational sectional views showing conditions when the sheet cassette is dismounted from the sheet feeder.
Figure 8:
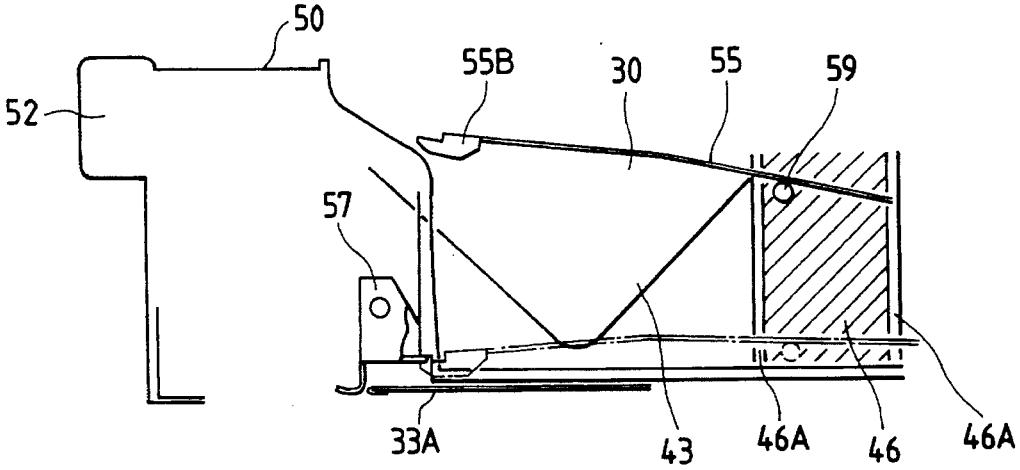
Figure 9:
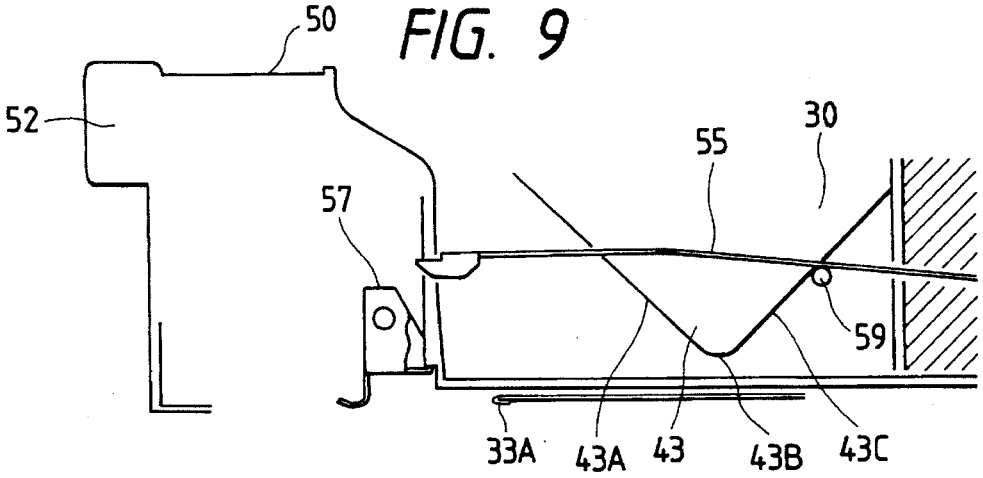
Figure 10:
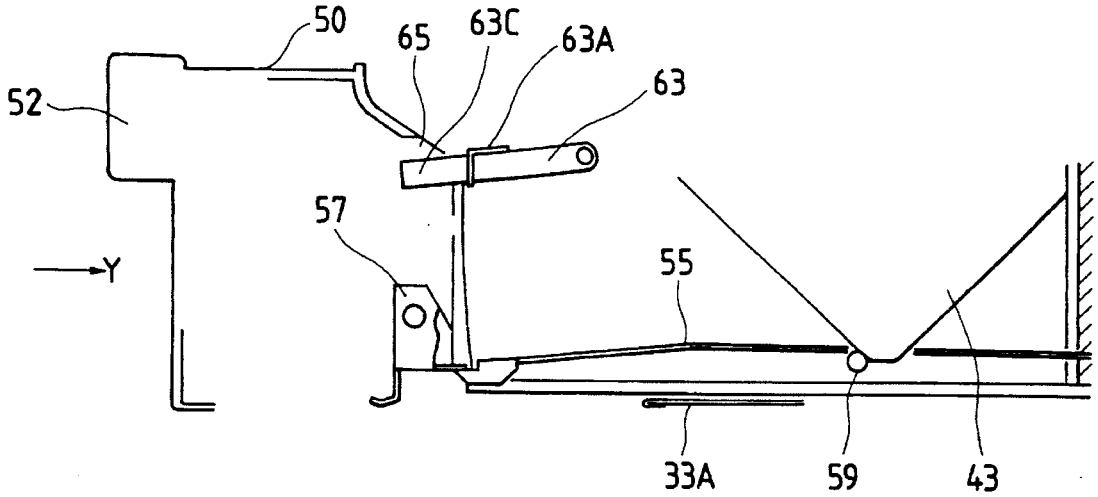

The sheet cassette 50 is dismounted from the sheet feeder 30 by gripping the gripper portion 52 of the cassette and by pulling the cassette in a direction shown by the arrow X in FIG. 7. At the initial stage of the dismounting of the sheet cassette 50, the lock pawl 57 is separated from the lock releasing tab 33A as the cassette continues to be retracted from the feeder, with the result that the lock pawl 57 is rotated in the counterclockwise direction by the biasing force of the tension spring 58, thereby abutting the pawl against the rib 61 to hold the pawl in the lock position (condition shown in FIG. 8).

As the sheet cassette 50 is further retracted, the left and right ends 59L, 59R of the push-down rod 59 protruding outwardly from the left and right side walls 51B, 51C of the sheet cassette 50 are engaged by the rear inclined portions 43C of the cams 43 formed on the inner surfaces of the left and right elongated supports 32L, 32R of the sheet feeder 30. Further retraction of the sheet cassette 50 causes the left and right ends 59L, 59R of the push-down rod 59 to lower along the rear inclined portions 43C, thereby shifting the push-down rod 59 in the inclined slots 60 from their upper end limit positions to lower end limit positions. This lowering movement of the push-down rod 59 causes the movable support plate 55 to rotate downwardly around its pivot pins 55A (condition shown in FIG. 9).

By further retracting the sheet cassette 50, the movable support plate 55 is lowered to a lowermost position by the cams 43, during which the locking portions 55B formed on the front end of the support plate 55 ride over the lock pawl 57 while pushing the latter, and, eventually, locking portions 55B are engaged by the bottom of the lock pawl. As a result, the movable sheet support plate 55 is locked near the bottom of the sheet cassette 50, and, in this condition, the sheet cassette is completely dismounted from the sheet feeder 30 (condition shown in FIG. 10). In the condition that the movable support plate 55 is locked, the lock releasing arm 57C of the lock pawl 57 is covered by the protection cover 64 of the bottom wall 51E of the sheet cassette 50 not to easily access thereto (refer to FIG. 5). Further, since the other portion of the lock pawl 57 is substantially accommodated within the sheet cassette 50, the lock is not inadvertently released during the normal sheet replenishing operation.

The replenishment of the sheets into the sheet cassette 50 is effected through the top opening of the cassette body case 51 after the sheet cassette 50 has been dismounted from the sheet feeder 30 as mentioned above. In the condition that the sheet cassette 50 is dismounted from the sheet feeder 30, as mentioned above, the movable sheet support plate 55 in the cassette body case 51 is locked near the bottom wall 51E of the case 51. Further, since the free end portions 63C of the separating claw levers 63 on which the separating claws 63A are provided are received in the openings 65 formed in the front wall 51A of the cassette body case 51 and ride on lower edges of the openings 65 not to rotate downwardly, the separating claws 63A are held at upper positions near the openings 65. Accordingly, a great distance between the front end of the movable sheet support plate 55 and the separating claws 63A is maintained, thus facilitating the quick insertion of the sheets P in the cassette body case 51.

The sheet cassette 50 is mounted to the sheet feeder 30 in such a manner that the sheet cassette 50 with its rear wall 51D facing forwardly is inserted into the cassette accommodating space C (FIG. 1) defined by the lower surface of the upper plate 31 of the sheet feeder 30, the upper surface of the lower plate 33 and the inner surfaces of the left and right elongated supports 32L, 32R from the front side of the feeder 30 (in a direction shown by the arrow Y in FIG. 10) while slidingly engaging the left and right elongated flanges 54L, 54R of the cassette by the longitudinal guide grooves 42 formed in the inner surfaces of the left and right supports 32L, 32R of the feeder 30.

The movements of various elements during the mounting of the sheet cassette 50 are reverse to those during the dismounting of the cassette. That is to say, immediately before the sheet cassette 50 is properly mounted to the sheet feeder 30, the left and right ends 59L, 59R of the push-down rod 59 protruding outwardly from the left and right side walls 51B, 51C of the sheet cassette 50 are engaged by the front inclined surfaces 43A of the cams 43 formed in the inner surfaces of the left and right supports 32L, 32R of the sheet feeder 30 and then ride over the cams 43.

The further inserting movement of the sheet cassette 50 causes the lock releasing arm 57C of the lock pawl 57 to abut against the lock releasing tab 33A, thereby rotating the lock pawl 57 in the clockwise direction to release the locking condition. As a result, the sheet support plate 55 of the sheet cassette 50 is rotated upwardly around the rear pivot pins 55A by the biasing force of the urging spring 62. However, when the locking condition is released, since the left and right ends of the push-down rod 59 are engaged by the friction members 46 (as shown by the phantom line in FIG.

8), the push-down rod 59 is subjected to the sliding resistance from the friction members 46, with the result that the movable sheet support plate 55 is upwardly rotated slowly. The upward rotation of the movable sheet support plate 55 is stopped when the front corners of the sheet stack or the movable support plate 55 are abutted against the separating claws 63A.

When the sheet cassette 50 is completely mounted to the sheet feeder, the sheet convey rollers 68 of the sheet cassette 50 are contacted with the sheet feed roller 36 of the sheet feeder 30.

Until immediately before the sheet cassette 50 is properly mounted to the sheet feeder 30, the movable support plate 55 is locked near the bottom wall 51E of the cassette body case 51 by the lock pawl 57 so that the sheet stack P on the movable support plate 55 is contained in the cassette body case 51 in a horizontal condition. Further, the sheet supply roller 35 provided in the upper plate 31 of the sheet feeder 30 comprises the semi-circular rollers (D-cut roller) as mentioned above which are normally stopped with their D-cut portions 35A facing downwardly. Thus, during the mounting and dismounting of the sheet cassette 50, the upper surface of the sheet stack P in the cassette body case 51 is adequately spaced apart from the downwardly facing D-cut portions of the sheet supply roller 35, with the result that the sheet stack in the sheet cassette does not interfere with the sheet supply roller 35 of the sheet feeder 30.

In a condition that the sheet cassette 50 is properly mounted to the sheet feeder 30, when a sheet supply signal is inputted from the image forming apparatus, the sheet supply roller 35 is rotated by one revolution by the action of the gear train G, clutch (not shown) and electromagnetic solenoid (not shown). As a result, the uppermost sheet is separated from the sheet stack by the separating claws 63A and is fed toward the front wall 51A of the sheet cassette 50. Then, the sheet is introduced into a nip between the sheet feed roller 36 of the sheet feeder 30 and the sheet convey rollers 68 of the sheet cassette 50 from below and is pinched by the nip, thereby feeding the sheet upwardly into the image forming apparatus. As the amount of sheets in the sheet cassette 50 is decreased, the movable sheet support plate 55 is gradually lifted by the biasing force of the urging spring 62.

In this way, whenever the sheet supply roller 35 of the sheet feeder 30 is rotated by one revolution, the sheet in the sheet cassette 50 mounted to the sheet feeder 30 is sent to the image forming apparatus one by one, and the image forming operation is effected for that sheet.

The sheet supplying apparatus is constituted as mentioned above, and, during the mounting of the sheet cassette 50 to the image forming apparatus, when the movable sheet support plate 55 is unlocked, the left and right end surfaces of the push-down rod 59 has already been engaged by the friction members 46. Thus, since the push-down rod 59 is subjected to the sliding resistance from the friction members 46 during the lifting movement thereof, the movable sheet support plate 55 does not abruptly spring up when the locking condition is released, thereby providing good operability and easy and quick replenishment of the sheets without damaging the image forming apparatus and the sheets.

In the illustrated embodiment, while the friction brake was used as the buffer means, the purpose of the present invention is to relieve the lifting movement of the movable sheet support plate 55 after the locking condition is released, and, accordingly, it should be noted that an elastic member such as a spring, a torque limiter, an air dumper, an electromagnetic brake and the like may be used as the buffer means.

In the illustrated embodiment, the friction members 46 are positioned out of range within which the push-down rod 59 of the sheet support plate 55 is shifted during the sheet supplying operation after the sheet cassette 50 is properly mounted to the sheet feeder 30.

Since the illustrated embodiment is constituted as mentioned above, during the mounting and dismounting of the sheet cassette 50, the push-down rod 59 of the sheet support plate 55 is not engaged by both the friction members 46 and the cams 43 simultaneously. Thus, in the dismounting of the sheet cassette 50, the push-down rod is not subjected to sliding resistance from the friction members 46 and support plate lowering resistance from the cams 43 simultaneously, thereby reducing cassette dismounting resistance, thus providing good operability.

According to the illustrated embodiment, in the cassette dismounting operation, the sliding resistance of the friction members 46 and the support plate lowering resistance of the cams 43 acts on the push-down rod independently. To this end, for example, the friction members 46 are made retractable so that, during the lowering of the sheet support plate 55 in the dismounting of the sheet cassette 50, the friction members 46 are retracted to a position where the friction members do not interfere with the sheet support plate 55.

Figure 11:
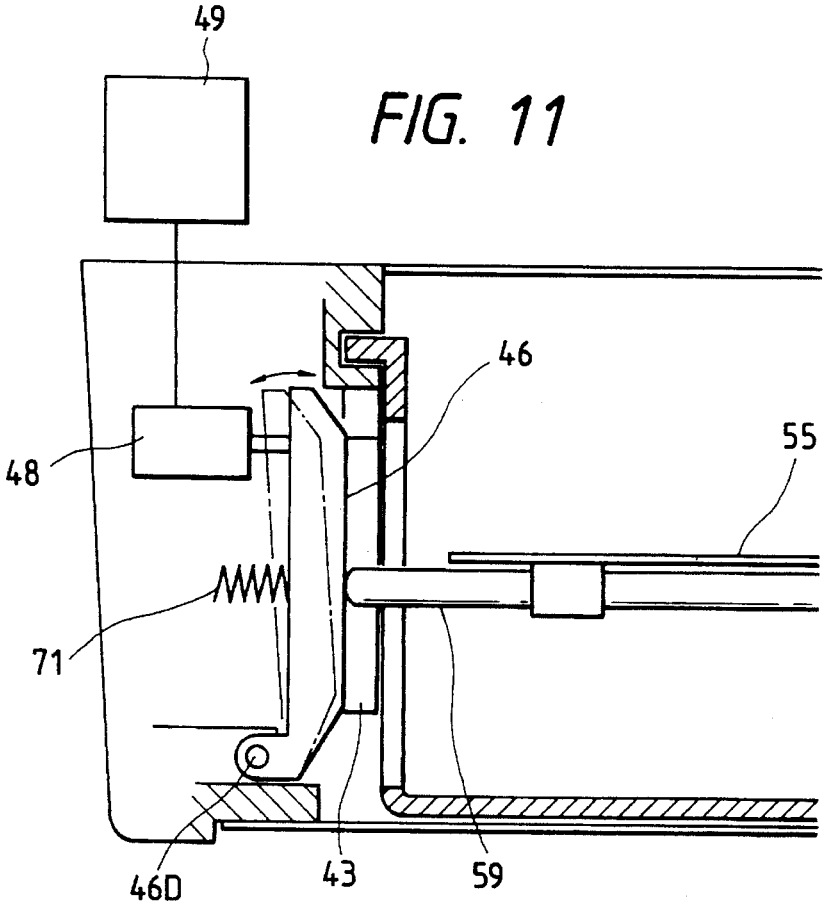
FIG. 11 is a partial sectional view of a sheet supplying apparatus according to a second embodiment of the present invention.

FIG. 11 shows a second embodiment of the present invention.

In this embodiment, each friction member 46 is pivotally mounted on a lower pivot pin 46D for rotation in a direction shown by the arrow. The reference numeral 71 denotes a compression spring for biasing the friction member 46 to abut it against the push-down rod 59 of the sheet support plate; and 48 denotes an electromagnetic solenoid for holding the friction member 46 at a retracted position where the friction member is spaced apart from the push-down rod 59.

The electromagnetic solenoid 48 is controlled by a control means 49 in such a manner that it rotates the friction member 46 to the retract position in opposition to a biasing force of the compression spring 71 in response to the sheet supply start signal from the image forming apparatus, thereby holding the friction member at the retract position, and releases the friction member 46 in response to the sheet supply finish signal. When released, the friction member 46 is rotated, by the compression spring 71, to a buffer position where the friction member is abutted against the push-down rod of the sheet support plate.

Since this embodiment is constituted as mentioned above, both end faces of the push-down rod 59 are spaced apart from the friction members 46 of the left and right supports 32L, 32R of the sheet feeder 30 during the sheet supplying operation so that the friction members 46 do not interfere with the movement of the movable sheet support plate 55 when the sheet P is supplied into the image forming apparatus. Thus, the friction members 46 do not influence the sheet supplying pressure for urging the sheet P against the sheet supply roller 35, thereby achieving the same advantage as the first embodiment with keeping the stable sheet supplying pressure.

According to this embodiment, at least in the sheet supplying operation, the friction members 46 do not influence the sheet supplying pressure. To this end, for example, the above control may be effected by using ON/OFF of a signal representative of cassette mounting completion from a sensor, or the retracting operation of the friction members 46 may be synchronous with the operation of the sheet supply roller 35 by retracting the friction members 46 by a drive source for the sheet supply roller 35. Further, it should be noted that the push-down rod 59 of the sheet support plate may be retracted.

Next, a third embodiment of the prevent invention will be explained with reference to FIG. 12.

Figure 12:
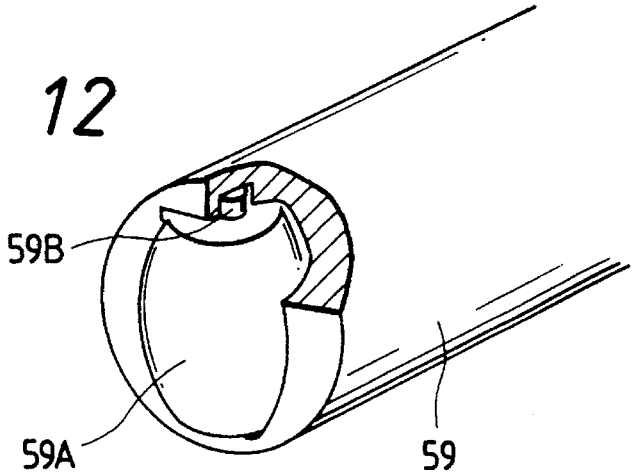
FIG. 12 is a partial perspective view of a sheet supplying apparatus according to a third embodiment of the present invention.

In FIG. 12 showing a perspective view of one end of a push-down rod 59 of a movable sheet support plate of a sheet cassette 50, a crown-shaped or barrel-shaped roller 59A is disposed at an end face of the push-down rod 59. The roller 59A is rotatable around a pivot shaft 59B extending in a direction substantially perpendicular to a cassette mounting and dismounting direction. The push-down rod 59 is non-rotatably secured to the sheet support plate 55.

According to this embodiment, the sliding resistance generated between the push-down rod 59 and the friction members 46 during the mounting and dismounting of the sheet cassette 50 is reduced by the rotation of the rollers 59A. On the other hand, after the locking condition is released, since the movable sheet support plate 55 is lifted in a direction substantially parallel with the pivot shafts 59B of the rollers 59A, the sliding resistance is not reduced by the rotation of the rollers 59A.

Figure 13:
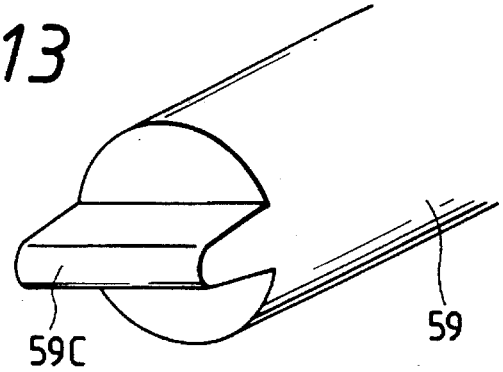
FIG. 13 is a partial perspective view of a sheet supplying apparatus according to a fourth embodiment of the present invention.
Figure 14:
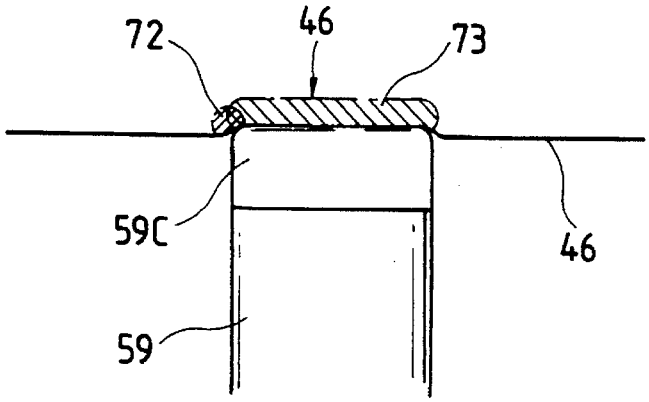
FIG. 14 is a view showing an engagement condition between a push-down rod and a friction member in the fourth embodiment of the present invention.

Next, a fourth embodiment of the present invention will be explained with reference to FIGS. 13 and 14. FIG. 13 is a perspective view of one end of a push-down rod 59 of a movable sheet support plate, and FIG. 14 is a plan view showing an engagement relation between the push-down rod 59 and a friction member 46.

In this embodiment, the push-down rod 59 is non-rotatably secured to the movable sheet support plate 55, and an elongated rib 59C extending in a horizontal direction substantially parallel with the cassette mounting and dismounting direction is formed on each end surface of the push-down rod 59. Incidentally, each friction member 46 is made of flexible material. As shown in FIG. 14, the positional relation between the friction members 46 and the push-down rod 59 is set so that the end ribs 59C of the push-down rod 59 are abutted against the friction members 46 while deforming it.

According to this embodiment, although the sliding movement between the push-down rod 59 and the friction members 46 generates not only friction resistance but also deforming resistance for deforming the friction members 46, a deformed area 72 of each friction member 46 due to the sliding movement in the cassette mounting and dismounting direction is smaller than a deformed area 73 of the friction member due to the sliding movement in the lifting direction of the movable support plate 55. Thus, the above-mentioned sliding resistance in the cassette mounting and dismounting direction is smaller than that in the lifting direction of the movable support plate 55.

With the arrangement as mentioned above, according to this embodiment, it is possible to reduce the mounting and dismounting resistance of the sheet cassette 50 while providing the sufficient braking force for relieving the lifting movement of the movable sheet support plate 55, and to achieve the same advantage as that of the first embodiment while providing good operability.

Figure 15:
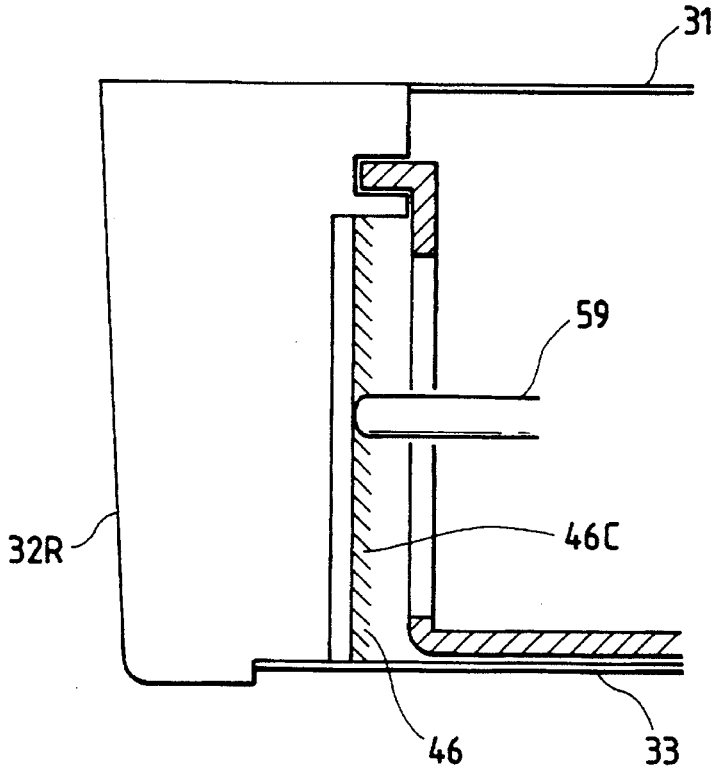
FIG. 15 is a partial sectional view of a sheet supplying apparatus according to a fifth embodiment of the present invention.

Next, explaining a fifth embodiment of the present invention with reference to FIG. 15 showing an elevational sectional view of a friction member 46, flexible elements 46C are arranged on a surface of the friction member 46 with the predetermined density and with the downward oblique orientation as shown.

Figure 16:
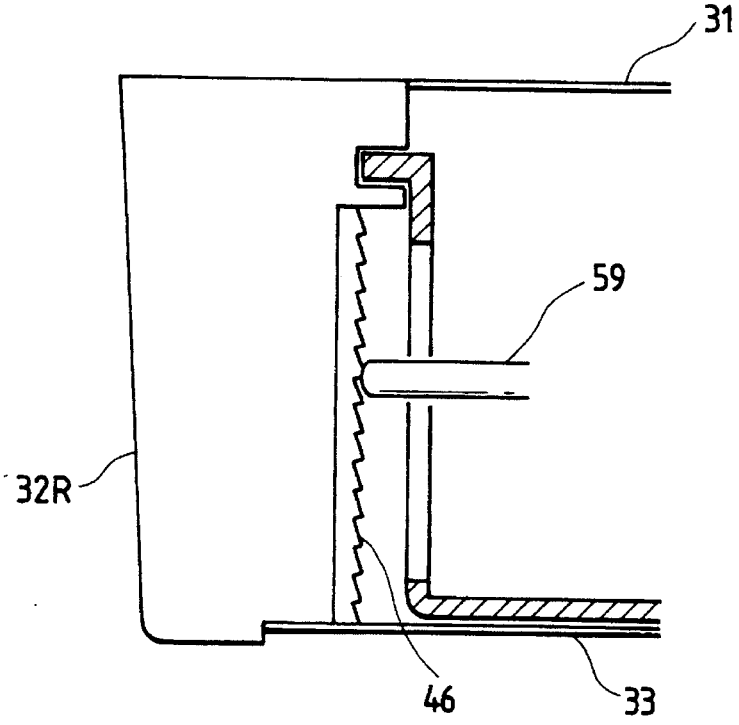
FIG. 16 is a partial sectional view of a sheet supplying apparatus according to a sixth embodiment of the present invention.

Next, explaining a sixth embodiment of the present invention with reference to FIG. 16, each friction member 46 is made of flexible material, and a surface of the friction member has an indentation comprising a plurality of downwardly inclined surfaces and a plurality of horizontal surfaces.

In the above fifth and sixth embodiments, the sliding resistance between the push-down rod 59 and the friction members 46 in the movement of the push-down rod 59 in an upward direction becomes greater than those in other directions.

Figure 17:
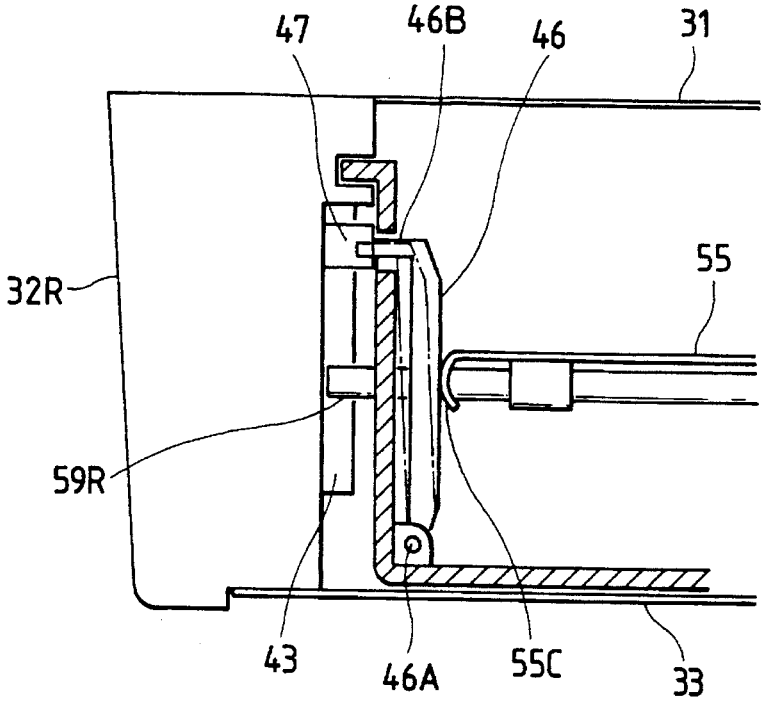
FIG. 17 is a partial sectional view of a sheet supplying apparatus according to a seventh embodiment of the present invention.
Figure 18:
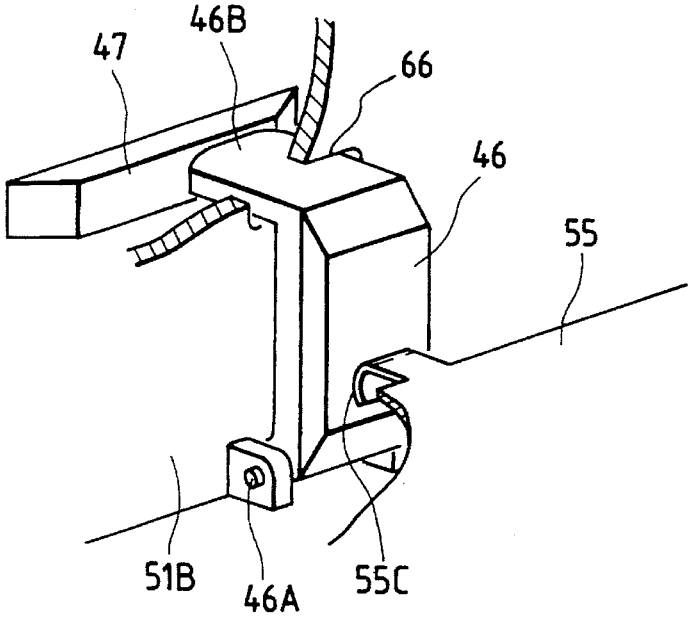
FIG. 18 is a partial perspective view of a sheet supplying apparatus according to the seventh embodiment of the present invention.
Figure 19A:
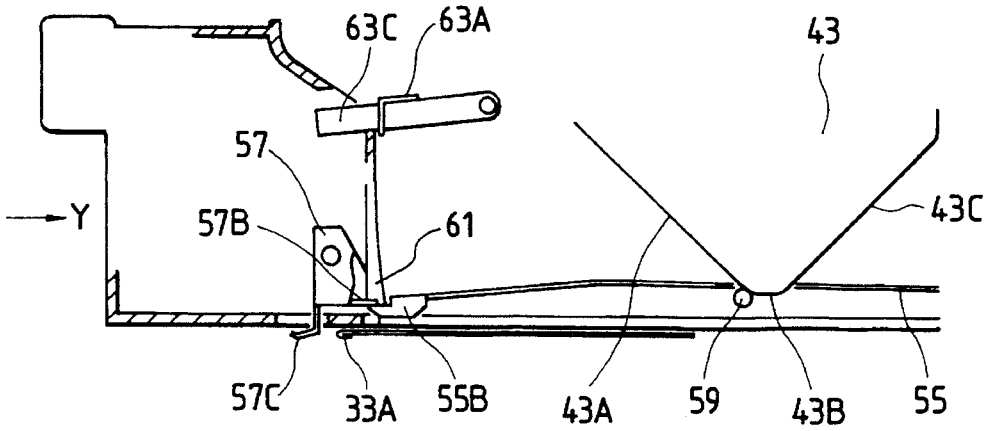
FIGS. 19A to 19F are views showing an operation of a sheet supplying apparatus according to an eighth embodiment of the present invention.
Figure 19B:
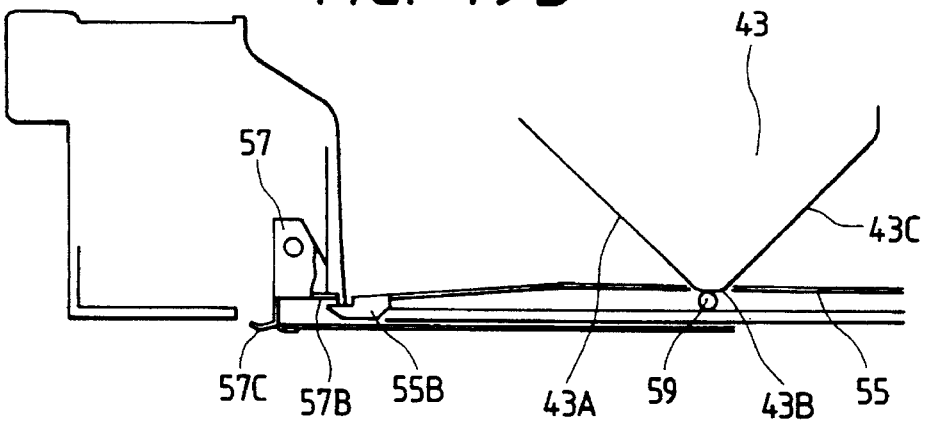
Figure 19C:
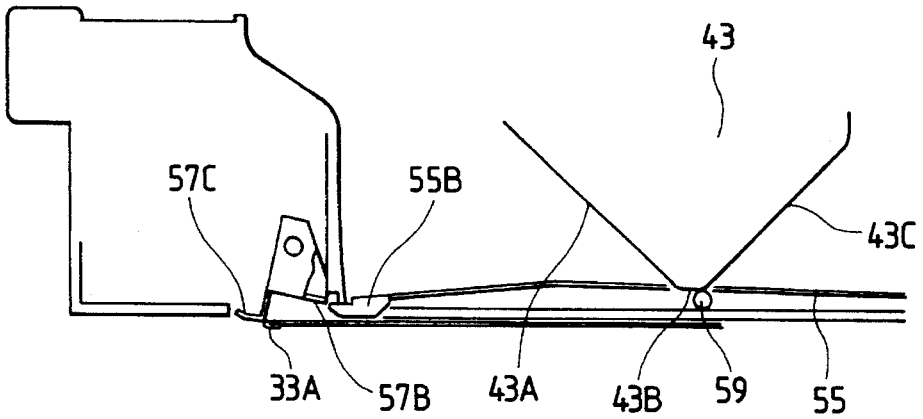
Figure 19D:
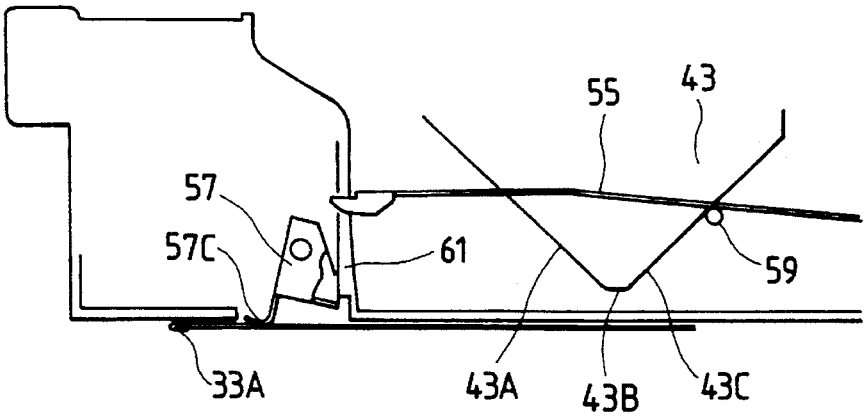
Figure 19E:
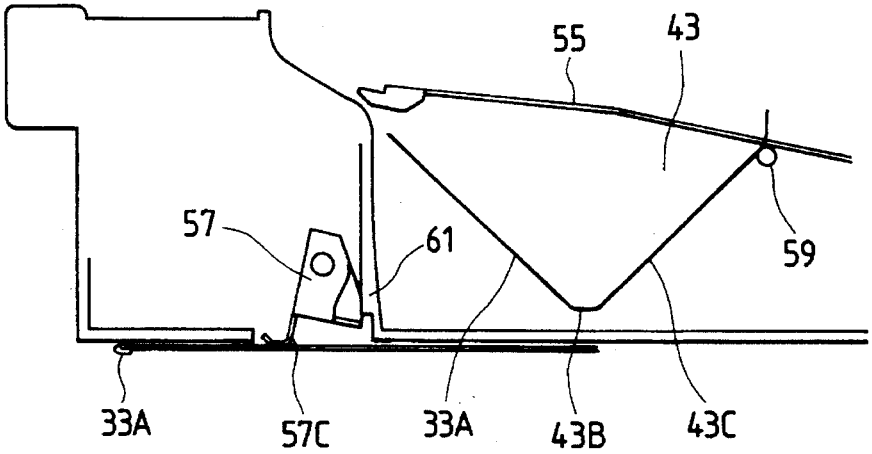
Figure 19F:
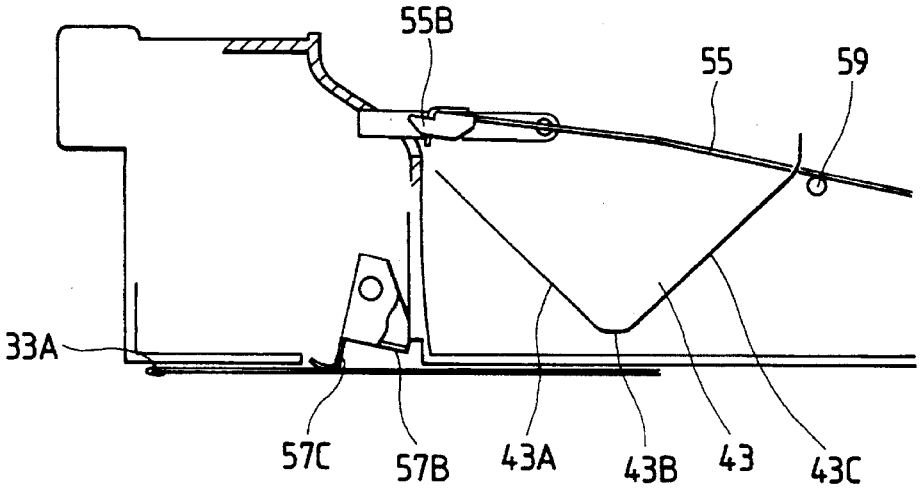

Next, a seventh embodiment of the present invention will be explained with reference to FIGS. 17 and 18. FIG. 17 is a sectional view of a main part of a means for resisting a pivotal movement of a movable sheet support plate 55 of a sheet cassette 50, and FIG. 18 is a perspective view of such means.

Friction projections 55C protrude symmetrically from left and right side edges of the movable sheet support plate 55 of the sheet cassette 50 and each friction projection 55C has a bent portion curved in an up-and-down direction. Friction members 46 are symmetrically pivotally mounted on the left and right side walls 51B, 51C of the sheet cassette 50 via pivot pins 46A. Each friction member 46 is biased by a spring (not shown) to be spaced apart from the corresponding friction projection 55C of the movable sheet support plate 55.

The friction members 46 are provided with upper ribs 46B which protrude outwardly through openings 66 formed in the left and right side walls 51B, 51C. Friction member activating cams 47 are symmetrically formed on the inner surfaces of the left and right elongated supports 32L, 32R of the sheet feeder 30.

During the mounting of the sheet cassette 50 to the sheet feeder 30, immediately before the locking condition of the movable sheet support plate 55 is released, the ribs 46B of the friction members 46 are engaged by the friction member activating cams 47 of the left and right elongated support 32L, 32R of the feeder 30, thereby rotating the friction members 46 around the pivot pins 46A to abut against the respective friction projections 55C of the movable sheet support plate 55.

Further inserting movement of the sheet cassette 50 causes the locking condition of the movable sheet support plate 55 to release, with the result that the movable sheet support plate 55 is gradually lifted while being subjected to the sliding resistance from the friction members 46. Further, when the sheet cassette 50 is properly mounted to the sheet feeder, the ribs 46B of the friction members 46 ride over the friction member activating cams 47 of the left and right elongated supports 32L, 32R of the sheet feeder 30 to be spaced apart therefrom, with the result that the friction members 46 are separated from the respective friction projections 55C of the movable sheet support plate 55 by the biasing forces of the springs (not shown).

With the arrangement as mentioned above, according to this embodiment, the sliding movement between the friction member activating cams 47 and the friction members 46 during the cassette mounting and dismounting operations is effected via the ribs 46B each having the relatively small sliding resistance, and there is no sliding movement between the elements forming the sheet cassette 50 and the sheet feeder 30 and the friction members 46 in the cassette mounting and dismounting direction. Accordingly, it is possible to provide the good operability and to achieve the same advantage as that of the first embodiment while maintaining the sufficient braking force for the lifting movement of the movable sheet support plate 55. Further, it is possible to provide the constant cassette mounting and dismounting resistance regardless of the friction of coefficient of the friction members 46, and to select the optimum friction members to not exert any negative influence upon the cassette mounting and dismounting resistance regardless of the kinds of the image forming apparatuses.

As mentioned above, when the lock means for locking the sheet stacking movable support plate at the predetermined position is released by the releasing means, since the abrupt lifting movement of the movable support plate is relieved by the action of the support plate biasing means, the collision between the movable support plate or the sheet stack and the separation means and the sheet supply means is relieved. Thus, it is possible to prevent damage of replenished sheets and sheet jam due to the deviation of the stacking position.

Next, an eighth embodiment of the present invention will be explained with reference to FIGS. 19A to 19F.

In this embodiment, the abrupt lifting movement is relieved by using cams. These cams may be the above-mentioned cams 43 for lowering the movable sheet support plate 55 when the sheet cassette 50 is retracted from the sheet feeder. More specifically, as mentioned above, the sheet cassette 50 is mounted to the sheet feeder 30 in such a manner that the sheet cassette 50 with its rear wall 51D facing forwardly is inserted into the cassette accommodating space C (FIG. 1) from the front side of the feeder 30 (in a direction shown by the arrow Y in FIG. 19A) while slidingly engaging the left and right elongated flanges 54L, 54R of the cassette by the longitudinal guide grooves 42 formed in the inner surfaces of the left and right supports 32L, 32R of the feeder.

The movements of various elements during the mounting of the sheet cassette are reverse to those during the dismounting of the cassette. That is to say, immediately before the sheet cassette 50 is properly mounted to the feeder 30, the left and right ends 59L, 59R of the push-down rod 59 protruding outwardly from the left and right side walls 51B, 51C of the sheet cassette 50 are engaged by the front inclined surfaces 43A of the cams 43 formed in the inner surfaces of the left and right supports 32L, 32R of the sheet feeder 30. The further inserting movement of the sheet cassette 50 causes the left and right ends 59L, 59R of the push-down rod to lower the horizontal portions 43B of the cams 43, thereby lowering the movable sheet support plate 55 to the lowermost position where the support plate 55 is separated from the front end 57B of the lock pawl 57.

While the left and right ends 59L, 59R of the push-down rod are being passed through the horizontal portions 43B of the cams 43, the lock releasing arm 57C of the lock pawl 57 is abutted against the lock releasing tab 33A of the movable support plate 55, thereby rotating the lock pawl 57 in the clockwise direction to release the locking condition. Thereafter, the left and Tight ends 59L, 59R of the push-down rod ride on the rear inclined portions 43C of the cams 43, with the result that the left and right ends 59L, 59R of the push-down rod are shifted along the rear inclined portions 43C by the urging spring 62 from the lower limit positions of the oblique slots 60 to their upper limit positions. Consequently, the movable sheet support plate 55 on which the sheet stack P is rested is rotated upwardly around the rear pivot pins 55A with the front end of the support plate being higher than the rear end thereof. When the front corners of the sheet stack or the movable sheet support plate 55 are abutted against the separating claws, a further rotation of the movable sheet support plate is prevented, and the left and right ends 59L, 59R of the push-down rod are separated from the cams 43 of the elongated supports of the feeder.

When the sheet cassette 50 is properly mounted to the sheet feeder, the sheet convey rollers 68 of the sheet cassette 50 are contacted with the sheet feed roller 36 of the sheet feeder 30.

In the above cassette mounting process, when the movable sheet support plate 55 is unlocked, since the left and right ends 59L, 59R of the push-down rod have already been engaged by the cams 43, the lifting movement of the push-down rod is subjected to the mounting resistance of the sheet cassette 50 to the sheet feeder 30, and, accordingly, the lifting movement of the push-down rod is effected slowly along the cams as the sheet cassette is inserted into the sheet feeder. Thus, when the locking condition does release, the movable sheet support plate 55 is not abruptly rise up, thereby obtaining good mounting feeling. Further, since the lifting force of the movable sheet support plate 55 acts in a direction that aids the mounting of the sheet cassette 50, it is possible to reduce the mounting resistance of the sheet cassette 50. In general, although the greater the sheet containing ability of the cassette the greater the mounting resistance of the cassette due to friction, since the elastic force of the urging spring 62 is made greater as the sheet containing ability of the cassette is increased, the above aiding effect will be increased accordingly.

As mentioned above, when the lifting movement of the support plate is relieved by using the cams, since the lifting force of the movable sheet support plate 55 (biasing force of the urging spring 62) gives a force for inserting the sheet cassette 50 toward the cassette mounting direction, it is possible to insert the cassette with a small force even when the sheet cassette is heavy, thereby providing good operability.

Figure 20:
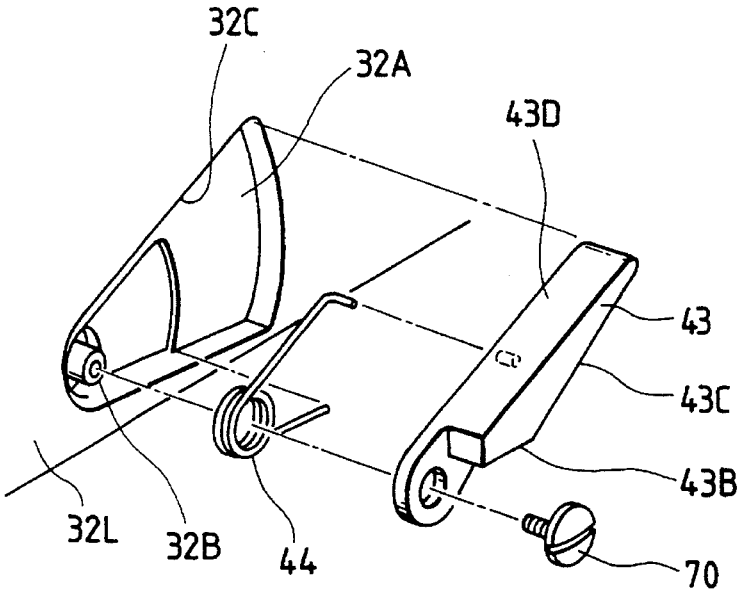
FIG. 20 is a perspective view showing another arrangement of a cam.

Next, an example of the construction will be explained. FIG. 20 is an exploded perspective view of one of the cams 43 acting as the sheet support plate lowering means.

The reference numeral 32A denotes a recess formed in the inner surface of the left or right supports 32L or 32R of the feeder; and 32B denotes a cam pivot disposed within the corresponding recess 32A at a position below and in front of a lowermost point 43B of the cam 43. The cam 43 is biased by a corresponding torsion coil spring 44 for rotation around the cam pivot 43B in an a counterclockwise direction so that an upper or front surface 43C of the cam is abutted against a corresponding inner surface 32C of the recess to regulate a further a counterclockwise rotation of the cam.

According to this example, when the sheet cassette 50 is dismounted from the sheet feeder 30, since the a counterclockwise rotation of the cams 43 is regulated, these cams act as the sheet support plate lowering means.

On the other hand, when the sheet cassette 50 is mounted to the sheet feeder 30, after the left and right ends 59L, 59R of the push-down rod 59 are abutted against the front surfaces 43D of the cams 43, the further insertion of the sheet cassette causes the cams 43 to rotate in the clockwise direction, thereby escaping the left and right ends 59L, 59R of the push-down rod. When the left and right ends 59L, 59R of the push-down rod ride over the cams 43, the cams 43 are returned to their predetermined positions by the biasing forces of the torsion coil springs 44.

Figure 21:
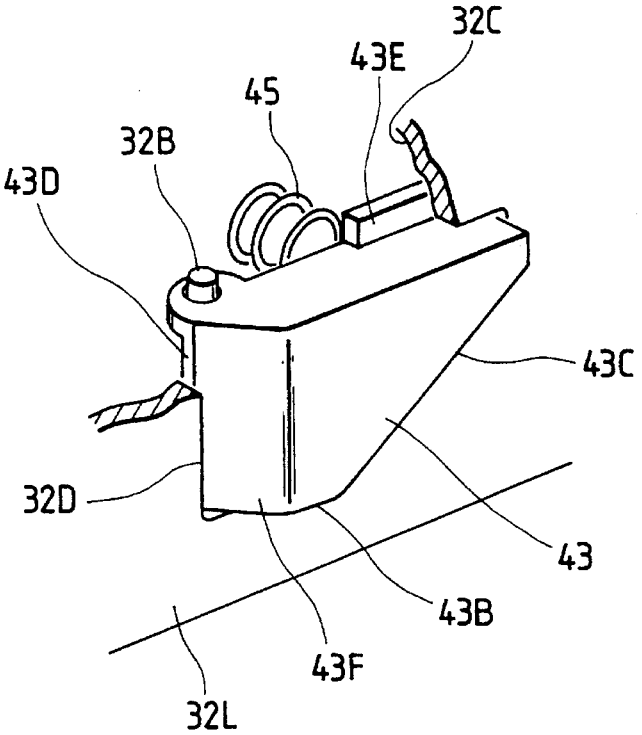
FIG. 21 is a perspective view showing a further arrangement of a cam.

FIG. 21 is a perspective view showing another example of one of cams 43 acting as the sheet support plate lowering means. The reference numeral 32B denotes a cam pivot arranged in the left or right support of the feeder at a front end of the cam 43; 43E denotes a flange integrally formed with the cam. The cams 43 protrude into the cassette accommodating space C through opening 32D formed in the walls of the left and right supports by biasing forces of compression springs 45. The rotations of the cams 43 are regulated by abutting the flanges 43E against the inner surfaces 32C of the left and right supports of the feeder. On the other hand, an inclined surface 43F is formed on each cam 43 near its front end, and a front end 43D of each cam 43 is positioned within the support 32L of the feeder.

According to this embodiment, when the sheet cassette 50 is dismounted from the sheet feeder 30, although the forces of the left and right ends 59L, 59R of the push-down rod of the cassette acting on the rear inclined portions 43C of the cams 43 direct toward a direction that the cams 43 protrude into the cassette accommodating space C, since the rotations of the cams 43 toward that direction are regulated, the cams 43 act as the sheet support plate lowering means as in the previous example.

When the sheet cassette 50 is mounted to the sheet feeder 30, the left and right ends 59L, 59R of the push-down rod of the cassette are abutted against the front inclined surfaces 43F of the cams 43 to rotate the cams toward the interiors of the left and right supports of the feeder in opposition to the biasing forces of the compression springs 44. When the left and right ends 59L, 59R of the push-down rod ride over the cams 43, the cams 43 are returned to their original positions by the biasing forces of the compression springs 44.

Figure 22:
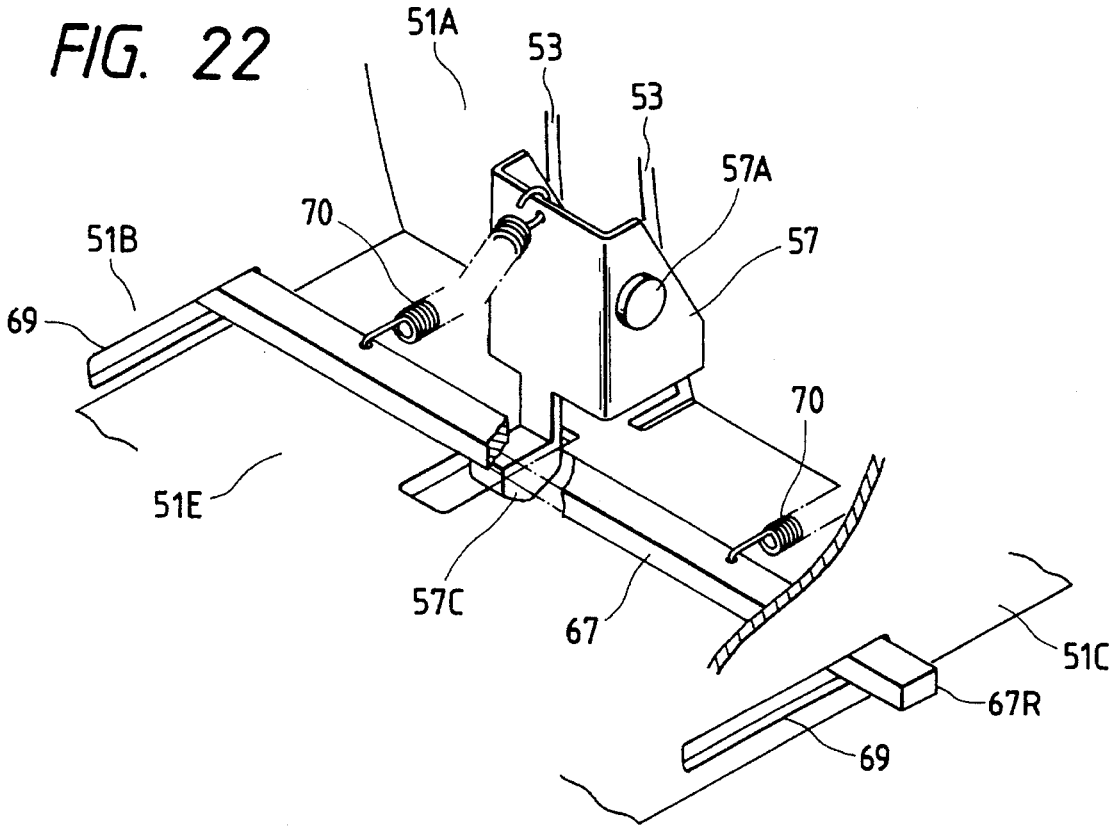
FIG. 22 is a perspective view of a lock mechanism for regulating a lock pawl in the first embodiment of the present invention.
Figure 23:
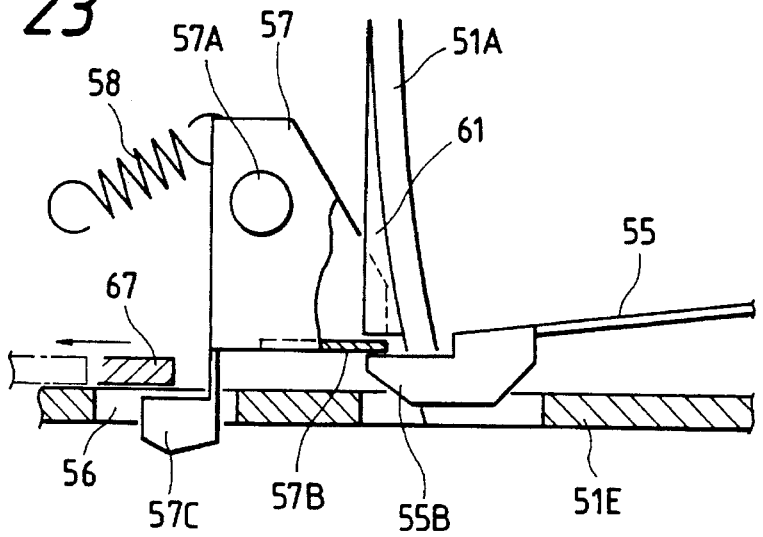
FIG. 23 is a sectional view of the lock mechanism of FIG. 22.
Figure 24:
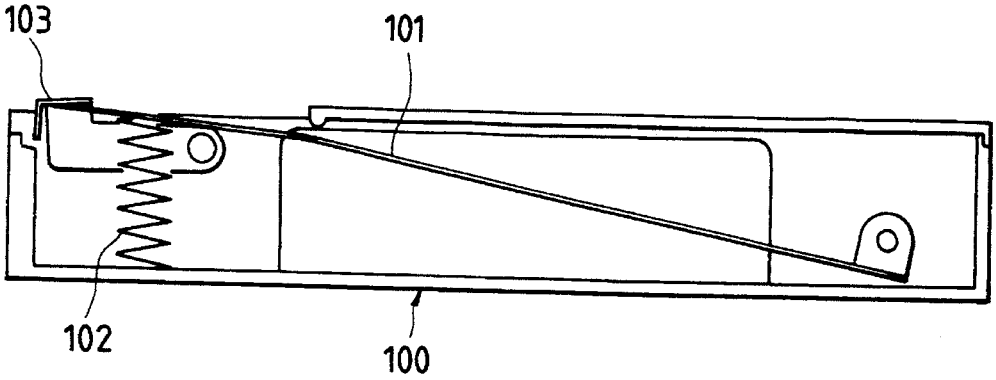
FIG. 24 PRIOR ART
FIG. 24 is a sectional view of a conventional sheet cassette.
Figure 25:
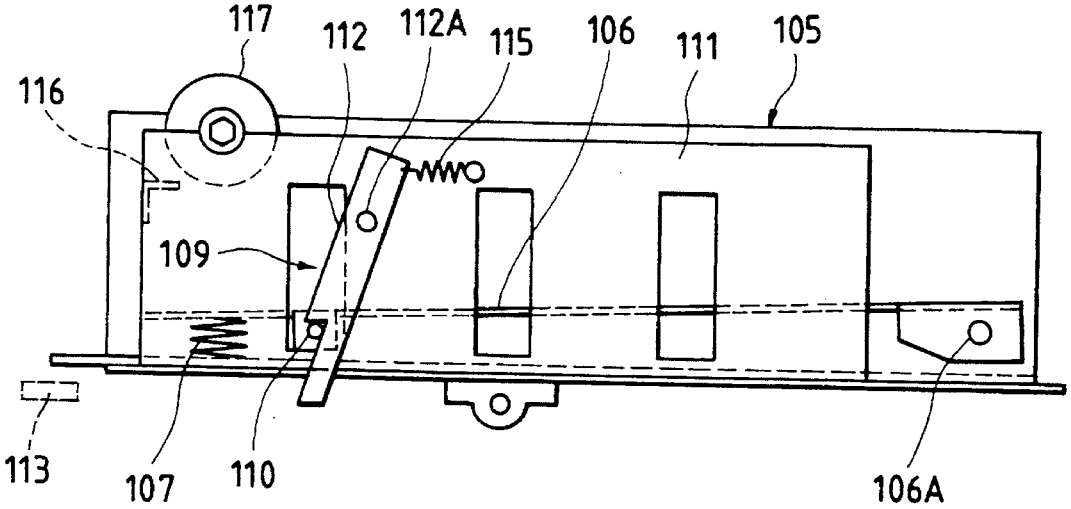
FIG. 25 PRIOR ART
FIG. 25 is a side view of a conventional sheet supplying apparatus.

FIG. 22 is a perspective view of a locking portion for regulating the rotation of the lock pawl 57, and FIG. 23 is a sectional view of such locking portion.

In FIG. 22, a safety bar 67 is disposed immediately above the lock releasing arm 57C of the lock pawl 57 and is shiftable in the sheet cassette mounting and dismounting direction. More particularly, the safety bar 67 is received in safety bar receiving slots 69 symmetrically formed in the left and right side walls 51B, 51C of the body case 51 of the sheet cassette 50 with left and right ends 67L, 67R of the bar protruding outwardly from the left and right side walls 51B, 51C. The safety bar 67 is biased toward the front wall 51A of the body case by tension springs 70.

In the condition that the sheet cassette 50 is dismounted from the sheet feeder 30, as shown in FIG. 23, the movable sheet support plate 55 is locked at the locked position by the lock pawl 57. On the other hand, the safety bar 67 is positioned immediately above the lock releasing arm 57C by the biasing forces of the tension springs 70. Thus, the rotation of the lock pawl 57 in the lock releasing direction (clockwise direction in FIG. 23) is prevented by abutting the lock releasing arm 57C against the safety bar 67, thereby preventing the advertent unlocking of the movable sheet support plate 55.

When the sheet cassette 50 is mounted to the sheet feeder 30, the left and right ends 67L, 67R of the safety bar 67 are abutted against the left and right supports 32L, 32R of the feeder. Then, the further insertion of the sheet cassette causes the safety bar 67 to shift in opposition to the biasing forces of the tension springs 70, with the result that, immediately before the lock releasing tab 33A of the movable support plate is abutted against the lock releasing arm 57C, the safety bar is shifted to a retract position shown by the phantom line in FIG. 23. The further insertion of the sheet cassette 50 causes the lock pawl 57 to rotate in the clockwise direction, thereby unlocking the movable sheet support plate 55. In this case, since the safety bar 67 is in the retract position, the bar does not interfere with the movement of the lock pawl 57.

With this arrangement, in the condition that the sheet cassette 50 is dismounted from the sheet feeder 30, the safety means for preventing the locking condition from releasing is effective; whereas, when the sheet cassette 50 is mounted to the sheet feeder 30, such safety means is released (becomes non-effective). Accordingly, during the normal sheet replenishing operation, the locking condition is not inadvertently released.

Figure 26:
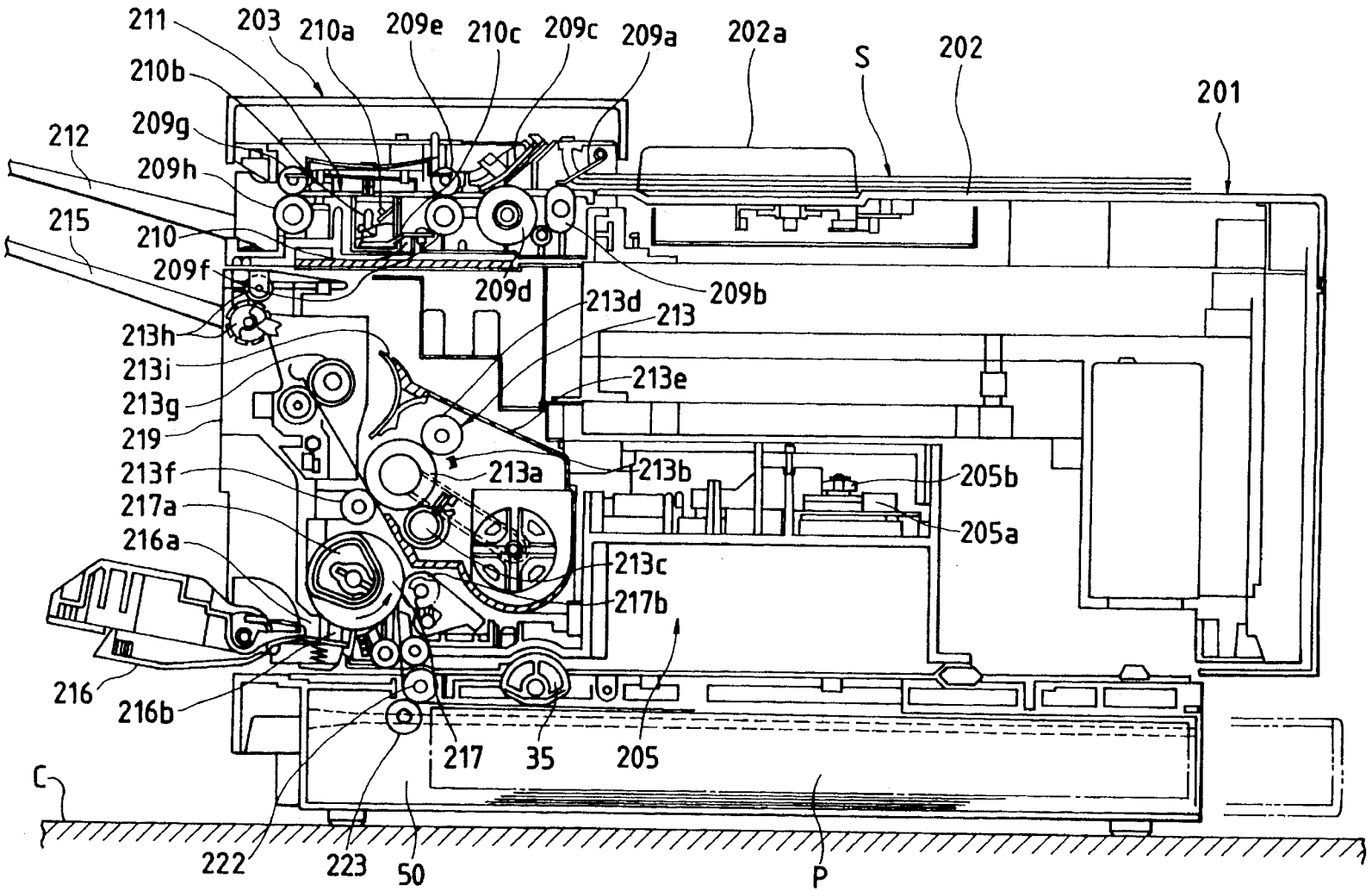
FIG. 26 is a sectional view of an image forming apparatus to which the present invention is applied.

Next, an image forming apparatus (facsimile apparatus) having the sheet supplying apparatus according to the present invention will be explained with reference to FIG. 26. Briefly explaining the whole construction of the facsimile apparatus, the facsimile apparatus comprises a sheet supplying apparatus A installed on a horizontal floor C and adapted to define a sheet supply portion, and a facsimile machine B rested on the sheet supplying apparatus A and adapted to receive a sheet from the sheet supplying apparatus A.

The facsimile machine B has an original stacking tray 202 which is formed on an upper cover of a frame 201 and on which a plurality of originals S can be stacked, and an optical reading system 203 for reading image information on the original S supplied from the original stacking tray 202 is arranged at one side (left side in FIG. 26) of an upper part of the frame 201. Further, a recording system 205 comprising a laser beam printer is disposed below the optical reading system 205. Further, a telephone (not shown) and an operation panel (not shown) are arranged on the upper surface of the frame 201.

The optical reading system 203 is designed so that the originals S stacked on the original stacking tray 202 are separated one by one by a pre-feed pushing member 209*a* and a pre-feed roller 209*b* abutted against the pushing member, and a separation pushing member 209*c* and a separation roller 209*d* abutted against the separation pushing member, and the separated original is sent to a contact sensor (sensor of contact type) 210 by an original supply roller 209*e* and a main feed roller 209*f* abutted against the supply roller. The image information on the original S is read while closely contacting the original S with the contact sensor 210 by an urging means 211, and then the original S is discharged onto an original discharge tray 212 by a discharge roller 209*g* and a discharge roller 209*h* abutted against the discharge roller 209*g*. The contact sensor 210 is designed so that light from an LED 210*a* as a light source is illuminated onto the image information surface of the original S, and the light reflected from the image information surface is focused on a photoelectric converter element 210*c* through a short-focus focusing lens 210*b*, thereby reading the image information. The read information is sent to a recording portion of another machine in a facsimile mode or is sent to the recording system 205 in a copy mode. Incidentally, left and right sliders 202*a* slidable in directions (widthwise direction of the original) perpendicular to an original feeding direction are arranged on the original stacking tray 202, so that the originals S are positioned in the left-and-right direction by slightly abutting the sliders against the left and right edges of the original stack S on the original stacking tray 202.

Further, the recording system 205 is designed so that a modulated signal is emitted from a laser beam generator 205*a* on the basis of an image signal from the contact sensor 210, and the modulated beam is illuminated onto a photosensitive drum 213*a* in an image forming station 213 as scanning light by a polygon mirror 205*b* thereby to form the image information on a surface of the photosensitive drum 213*a*, and the image information on the drum is transferred onto the sheet P supplied from the sheet supplying apparatus A and the image information is fixed to the sheet, and then the sheet S is discharged.

The photosensitive drum 213*a* is integrally incorporated into a recording cartridge (process cartridge) 213*e* together with a primary charger 213*b*, a developing roller 213*c* and a cleaning roller 213*d*, and the recording cartridge 213*e* is removably mounted to the frame 201 of the facsimile apparatus. The surface of the photosensitive drum 213*a* is uniformly charged by the primary charger 213*b*. When the scanning light from the polygon mirror 205*b* is illuminated on the surface of the photosensitive drum, a latent image is formed on the drum, which latent image is in turn visualized with toner from the developing roller 213*c*.

A transfer charger 213*f* is disposed around the photosensitive drum 213*a* in the image forming station 213, and fixing rollers 213*g* and discharge rollers 213*h* are disposed in a sheet feeding path arranged at a downstream side of the photosensitive drum 213*a*. After the toner image formed on the photosensitive drum 213*a* is transferred to the sheet P (supplied from the sheet supplying apparatus A) by the transfer charger 213*f*, the toner image is fixed to the sheet by the fixing rollers 213*g*, and then the sheet is discharged onto a sheet discharge tray 215 removably mounted on one side (left side in FIG. 26) of the frame 201 by the discharge rollers 213*h*.

Further, a stacking tray 216 for stacking manual insertion sheets P is openably mounted on one side of the frame 201 below the sheet discharge tray 215. By opening the stacking tray 216 in a horizontal condition, a manual sheet insertion opening 216*a* is opened. When the sheets S on the stacking tray 216 are inserted into the manual sheet insertion opening 216*a*, the sheets are urged against a larger feed roller 217*a* and a smaller feed rollers 217 (comprising the larger feed roller 217*a* and a smaller feed roller 217*b*) by an urging member 216*b*, thereby separating the sheets one by one by the feed roller 217*a*. Then, the separated sheet is sent between the transfer charger 213*f* and the photosensitive drum 213*a* by the paired feed rollers 217*a*, 217*b*.

Incidentally, the stacking tray 216 is openably (cockably) attached to an opening/closing lid 219 openably mounted on one side of the frame 201, and the sheet discharge tray 215 is also removably attached to the opening/closing lid 219. By opening the opening/closing lid 219, the recording cartridge 213*e* can be exchanged. Further, the opening/closing lid 219 is moved in synchronously with a drum shutter 213*i* provided on the recording cartridge 213*e* so that when the lid 219 is opened the drum shutter 213*i* is closed and when the lid 219 is closed the drum shutter 213*i* is opened.

Further, although not shown, an operation button for a release lever for releasing the lock of the opening/closing lid 219 is arranged in a recess formed in a front surface of the lid 219. The recess is normally closed by a protection cover integrally formed with the sheet discharge tray 215 so that the lock of the opening/closing lid 219 cannot be released by the operation button so long as the sheet discharge tray 215 is attached to the lid 219. Thus, the exchange of the recording cartridge in a half-opened condition of the opening/closing lid 219 (in this condition, the lid cannot be completely opened with the interference with the sheet discharge tray 215) can be prevented, thereby preventing the recording cartridge 123*e* from damaging. Further, since the half-opened condition of the lid 219 can be prevented, it is possible to prevent the half-opened condition of the drum shutter 213*i*, thereby preventing the deterioration of the image quality due to the exposure of the photosensitive drum 213*a*.

The sheets P fed out from the sheet cassette 50 are separated one by one by the D-cut sheet supply roller 35, and the separated sheet P is sent between the transfer charger 213*f* and the photosensitive drum 213*a* by a pair of regist rollers (paired convey rollers) 222, 223 via a pair of feed rollers 217 at a sheet supply timing that a tip end of the toner image formed on the photosensitive drum 213*a* is aligned with a leading end of the sheet P.

What is claimed is:

1. A sheet supplying apparatus comprising:

a sheet cassette removably mounted to a main body of said apparatus for accommodating the sheets, said sheet cassette comprising (i) a sheet support member shiftable between a sheet feeding position and a waiting position for supporting sheets, (ii) biasing means for biasing said sheet support member toward the sheet feeding position from the waiting position, and (iii) locking means for locking said sheet support member at the waiting position against a biasing force of said biasing means;

sheet supply means for feeding out the sheets supported on said sheet support member at the sheet feeding position;

releasing means for releasing the locking by said locking means in response to mounting of said sheet cassette to the main body, said sheet support member being shifted from the waiting position to the sheet feeding position by the biasing force of said biasing means when said locking means is released by said releasing means; and a friction member disposed in said main body for reducing a speed of the shift of said sheet support member effected by said biasing means by a friction force between said friction member and said sheet support member when said locking means is released by said releasing means.

2. A sheet supplying apparatus according to claim 1, wherein said friction member comprises flexible members arranged in a predetermined density at a position where they are contacted with said sheet support member.

3. A sheet supplying apparatus according to claim 1, wherein said friction member comprises an indentation at a position where it is contacted with said sheet support member.

4. A sheet supplying apparatus according to claim 1, further comprising a control shaft integrally formed with said sheet support member to reduce the shifting speed of said sheet support member by contacting said control shaft with said friction member.

5. A sheet supplying apparatus according to claim 4, further comprising resistance reducing means for providing resistance in a shifting direction of said sheet support member from the waiting position to the sheet feeding position to reduce the shifting speed of said sheet support member and providing substantially no resistance when mounting said sheet cassette, said resistance reducing means is provided on a portion of said control shaft to be contacted with said friction member.

6. A sheet supplying apparatus according to claim 5, wherein said resistance reducing means is a roller rotated during mounting and dismounting of said sheet cassette to the sheet supplying apparatus.

7. A sheet supplying apparatus according to claim 1, wherein said locking means comprises a rockable lock member for locking said sheet support member at the waiting position, and said releasing means rocks said lock member to release said sheet support member from the waiting position in response to said sheet cassette being mounted to the sheet supplying apparatus.

8. A sheet supplying apparatus according to claim 7, further comprising cam means for shifting said sheet support member to the waiting position against the biasing force of said biasing means in order to lock said sheet support member to said rockable lock member when said sheet cassette is dismounted from the sheet supplying apparatus.

9. A sheet supplying apparatus comprising:

a sheet cassette removably mounted to a main body of said apparatus for accommodating sheets, said sheet cassette comprising (i) a sheet support member shiftable between a sheet feeding position and a waiting position for supporting sheets, (ii) biasing means for biasing said sheet support member toward the sheet feeding position from the waiting position, and (iii) locking means for locking said sheet support member at the waiting position against a biasing force of said biasing means;

sheet supply means for feeding out the sheets supported on said sheet support member at the sheet feeding position; and a friction member for reducing a speed of the shift of said sheet support member effected by said biasing means by a friction force when said locking means is released in response to mounting of said sheet cassette to the main body, said friction member acting on said sheet support member before completion of mounting said sheet cassette on said sheet supplying apparatus.

10. A sheet supplying apparatus according to claim 9, wherein said friction member can be retracted from contact with said sheet support member, and further comprising retract means for retracting said friction member when said sheet cassette is completely mounted on said sheet supplying apparatus.

11. A sheet supplying apparatus according to claim 10, wherein said retract means comprises a solenoid for shifting said friction member to a retract position.

12. A sheet supplying apparatus according to claim 10, wherein said retract means comprises a cam provided on said sheet supplying apparatus adapted to contact said friction member to thereby shift said friction member between a contact position and a retract position.

13. A sheet supplying apparatus comprising:

a sheet cassette removably mounted to a main body of said apparatus for accommodating sheets, said sheet cassette comprising (i) a sheet support member shiftable between a sheet feeding position and a waiting position for supporting sheets, (ii) biasing means for biasing said sheet support member toward the sheet feeding position from the waiting position, and (iii) locking means for locking said sheet support member at the waiting position against a biasing force of said biasing means;

sheet supply means for feeding out the sheets supported on said sheet support member at the sheet feeding position;

shifting means for shifting said sheet support member to the waiting position to be locked by said locking means in response to dismounting of said sheet cassette from the main body;

releasing means disposed in said main body for releasing the locking by said locking means in response to mounting of said sheet cassette to the main body, said sheet support member being shifted from the waiting position to the sheet feeding position by the biasing force of said biasing means when said locking means is released by said releasing means; and buffer means for reducing a speed of the shift of said sheet support member effected by said biasing means when said locking means is released by said releasing means.

14. A sheet supplying apparatus according to claim 13, wherein said buffer means comprises a cam provided on the sheet supplying apparatus, and a control shaft provided on said sheet support member is slidingly contacted with said cam to reduce the shifting speed of said sheet support member, and an inclined portion is provided for urging said control shaft toward the main body during mounting of said sheet cassette.

15. A sheet supplying apparatus according to claim 14, wherein said cam acts to shift said sheet support member the to waiting position for locking of said locking means in response to dismounting of said sheet cassette from the sheet supplying apparatus.

16. A sheet supplying apparatus comprising:

a sheet cassette removably mounted to a main body of said apparatus for accommodating sheets, said sheet cassette comprising (i) a sheet support member shiftable between a sheet feeding position and a waiting position for support sheets, (ii) biasing means for biasing said sheet support member toward the sheet feeding position from the waiting position, and (iii) locking means for locking said sheet support member at the waiting position against a biasing force of said biasing means;

sheet supply means for feeding out the sheets supported on said sheet support member at the sheet feeding position;

releasing means for releasing the locking by said locking means in response to mounting of said sheet cassette to the main body, said sheet support member being shifted from the waiting position to the sheet feeding position by the biasing force of said biasing means when said locking means is released by said releasing means;

shifting and buffer means for shifting said sheet support member to the waiting position for locking by said locking means in response to dismounting of said sheet cassette from the main body and for reducing a speed of the shift of said sheet support member when said locking means is released by said releasing means in response to mounting of said sheet cassette to the main body.

17. A sheet supplying apparatus according to claim 16, wherein said locking means comprises a rockable lock member for locking said sheet support member, and said releasing means rocks said locking means to release a locking condition of said sheet support member in response to mounting of said sheet cassette to the main body.

18. A sheet supplying apparatus according to claim 17, wherein said shifting and buffer means comprises a cam for shifting said sheet support member to a locking position of said lock member against the biasing force of said biasing means in order to lock said sheet support member to said lock member in response to dismounting of said sheet cassette from the main body.

19. A sheet supplying apparatus according to claim 18, wherein said cam comprises an inclined portion with which a control shaft provided on said sheet support member is slidingly contacted to act as a buffer by reducing the shifting speed of said sheet support member and which urges said control shaft toward a mounting direction of said sheet cassette.

20. An image forming apparatus in which a sheet cassette is removably mounted to a main body of said apparatus for accommodating sheets, said sheet cassette comprising: (i) a sheet support member shiftable between a sheet feeding position and a waiting position for supporting sheets, (ii) biasing means for biasing said sheet support member toward the sheet feeding position from the waiting position, and (iii) locking means for locking said sheet support member at the waiting position against a biasing force of said biasing means;

sheet supply means for feeding out the sheets supported on said sheet support member at the sheet feeding position;

releasing means for releasing the locking by said locking means in response to mounting of said sheet cassette to the main body, said sheet support member being shifted from the waiting position to the sheet feeding position by the biasing force of said biasing means when said locking means is released by said releasing means;

a friction member disposed in said main body for reducing a speed of the shift of said sheet support member effected by said biasing means by a friction force between said friction member and said sheet support member when said locking means is released by said releasing means; and image forming means in the main body of the image forming apparatus for forming an image on the sheets from the sheet cassette.

21. An image forming apparatus in which a sheet cassette is removably mounted to a main body of said apparatus for accommodating sheets, said sheet cassette comprising: (i) a sheet support member shiftable between a sheet feeding position and a waiting position for supporting sheets, (ii) biasing means for biasing said sheet support member toward the sheet feeding position from the waiting position, and (iii) locking means for locking said sheet support member at the waiting position against a biasing force of said biasing means;

sheet supply means for feeding out the sheets supported on said sheet support member at the sheet feeding position;

a friction member for reducing a speed of the shift of said sheet support member effected by said biasing means by a friction force when said locking means is released, said friction member acting on said sheet support member only before completion of mounting said sheet cassette to said sheet supplying apparatus; and image forming means in the main body of the image forming apparatus for forming an image on the sheets from the main cassette.

22. An image forming apparatus in which a sheet is removably mounted to a main body of said apparatus for accommodating sheets, said sheet cassette comprising: (i) a sheet support member shiftable between a sheet feeding position and a waiting position for supporting sheets, (ii) biasing means for biasing said sheet support member toward the sheet feeding position from the waiting position, and (iii) locking means for locking said sheet support member at the waiting position against a biasing force of said biasing means, said locking means effecting a locking operation for facilitating loading of the sheets when said sheet cassette is drawn out from said main body;

sheet supply means for feeding out the sheets supported on said sheet support member at the sheet feeding position;

shifting means for shifting said sheet support member to the waiting position to be locked by said locking means in response to dismounting of said sheet cassette from the main body;

releasing means disposed in said main body for releasing the locking by said locking means in response to mounting of said sheet cassette to the main body, said sheet support member being shifted from the waiting position to the sheet feeding position by the biasing force of said biasing means when said locking means is released by said releasing means; and buffer means for reducing a speed of the shift of said sheet support member effected by said biasing means when said locking means is released by said releasing means; and image forming means in the main body of the image forming apparatus for forming an image on the sheets from the sheet cassette.

23. An image forming apparatus in which a sheet cassette is removably mounted to a main body of said apparatus for accommodating sheets, said sheet cassette comprising: (i) a sheet support member shiftable between a sheet feeding position and a waiting position for support sheets, (ii) biasing means for biasing said sheet support member toward the sheet feeding position from the waiting position, and (iii) locking means for locking said sheet support member at the waiting position against a biasing force of said biasing means;

sheet supply means for feeding out the sheets supported on said sheet support member at the sheet feeding position;

releasing means for releasing the locking by said locking means in response to mounting of said sheet cassette to the main body, said sheet support member being shifted from the waiting position to the sheet feeding position by the biasing force of said biasing means when said locking means is released by said releasing means;

shifting and buffer means for shifting said sheet support member to the waiting position for locking by said locking means in response to dismounting of said sheet cassette from the main body and for reducing a speed of the shift of said sheet support member when said locking means is released by said releasing means in response to mounting of said sheet cassette to the main body; and image forming means in the main body of the image forming apparatus for forming an image on the sheets from the sheet cassette.

24. A sheet supplying apparatus comprising:

a sheet cassette removably mounted to a main body of said apparatus for accommodating the sheets, said sheet cassette comprising (i) a sheet support member shiftable between a sheet feeding position and a waiting position for supporting sheets, (ii) biasing means for biasing said sheet support member toward the sheet feeding position from the waiting position, and (iii) locking means for locking said sheet support member at the waiting position against a biasing force of said biasing means;

sheet supply means for feeding out the sheets supported on said sheet support member at the sheet feeding position;

releasing means for releasing the locking by said locking means in response to mounting of said sheet cassette to the main body, said sheet support member being shifted from the waiting position to the sheet feeding position by the biasing force of said biasing means when said locking means is released by said releasing means;

a friction member for reducing a shift speed of said sheet support member effected by said biasing means by a friction force between said friction member and said sheet support member when said locking means is released by said releasing means said friction member is disposed in said sheet cassette and is shiftable between an active position and an inactive position; and an active member disposed in said main body for shifting said friction member from the inactive position to the active position in response to mounting of said sheet cassette to the main body.

25. A sheet supplying apparatus according to claim 24, wherein said friction member is supported in said sheet cassette rockably, and activate means rocks said friction member toward said support member to thereby generate a friction force between said friction member and said support member.

26. A sheet supplying apparatus according to claim 25, wherein said active member is an active cam provided in said body of sheet supplying apparatus.

27. A sheet supplying apparatus comprising:

a sheet cassette removably mounted to a main body of said apparatus for accommodating sheets, said sheet cassette comprising (i) a sheet support member shiftable between a sheet feeding position and a waiting position for supporting sheets, (ii) biasing means for biasing said sheet support member toward the sheet feeding position from the waiting position, and (iii) locking means for locking said sheet support member at the waiting position against a biasing force of said biasing means;

sheet supply means for feeding out the sheets supported on said sheet support member at the sheet feeding position;

a friction member for reducing by a friction force a speed of a shift of said sheet support member effected by said biasing means when said locking means is released in response to mounting of said sheet cassette to the main body, said friction member retractable from contact with said sheet support member; and retract means for retracting said friction member in response to a signal.

28. A sheet supplying apparatus according to claim 27, wherein the signal is a detection signal for detecting mounting of said sheet cassette.

29. A sheet supplying apparatus according to claim 27, wherein the signal is a supply signal for commanding a sheet feeding operation to said sheet supply means.

30. A sheet supplying apparatus according to claim 27, wherein said retract means is a solenoid connection to said friction member.

31. An image forming apparatus comprising:

a sheet cassette removably mounted to a main body of said apparatus for accommodating the sheets, said sheet cassette comprising (i) a sheet support member shiftable between a sheet feeding position and a waiting position for supporting sheets, (ii) biasing means for biasing said sheet support member toward the sheet feeding position from the waiting position, and (iii) locking means for locking said sheet support member at the waiting position against a biasing force of said biasing means;

sheet supply means for feeding out the sheets supported on said sheet support member at the sheet feeding position;

releasing means for releasing the locking by said locking means in response to mounting of said sheet cassette to the main body, said sheet support member being shifted from the waiting position to the sheet feeding position by the biasing force of said biasing means when said locking means is released by said releasing means;

a friction member for reducing a shift speed of said sheet support member effected by said biasing means by a friction force between said friction member and said sheet support member when said locking means is released by said releasing means said friction member is disposed in said sheet cassette and is shiftable between an active position and an inactive position;

an activate member disposed in said main body for shifting said friction member from the inactive position to the active position in response to mounting of said sheet cassette to the main body; and image forming means for forming an image on a sheet fed out by said sheet supply means.

32. An image forming apparatus comprising:

a sheet cassette removably mounted to a main body of said apparatus for accommodating sheets, said sheet cassette comprising (i) a sheet support member shiftable between a sheet feeding position and a waiting position for supporting sheets, (ii) biasing means for biasing said sheet support member toward the sheet feeding position from the waiting position, and (iii) locking means for locking said sheet support member at the waiting position against a biasing force of said biasing means;

sheet supply means for feeding out the sheets supported on said sheet support member at the sheet feeding position;

a friction member for reducing by a friction force a speed of a shift of said sheet support member effected by said biasing means when said locking means is released in response to mounting of said sheet cassette to the main body, said friction member retractable from contact with said sheet support member;

retract means for retracting said friction member in response to a signal; and image forming means for forming an image on a sheet fed out by said sheet supply means.

* * * * *

UNITED STATES PATENT AND TRADEMARK OFFICE

CERTIFICATE OF CORRECTION

PATENT NO. : 5,564,690

DATED : October 15, 1996

INVENTOR(S) : Oshida

It is certified that error appears in the above-indentified patent and that said Letters Patent is hereby corrected as shown below:

On the title page: Item

[56] References Cited

Change "2295828 12/1990 Japan" to --2-295828 12/1990 Japan--.
Change "440260542 9/1992 Japan" to --4-260542 9/1992 Japan--.

[57] ABSTRACT

Line 10, change "means;" to --device;--.

COLUMN 1

Line 66, change "spring" to --springs--.

COLUMN 4

Line 62, delete "a".

COLUMN 5

Line 8, delete "an".

COLUMN 10

Line 66, delete "the" (first occurrence).

COLUMN 11

Line 56, change "Tight" to --right--.

UNITED STATES PATENT AND TRADEMARK OFFICE

CERTIFICATE OF CORRECTION

PATENT NO. : 5,564,690

DATED : October 15, 1996

INVENTOR(S) : Oshida

It is certified that error appears in the above-indentified patent and that said Letters Patent is hereby corrected as shown below:

COLUMN 12

Line 15, change "does release" to --is released--;
Line 16, change "is" to --does--.

COLUMN 18

Line 12, delete "the".
Line 13, after "to" insert --the--.

Signed and Sealed this

First Day of April, 1997

Bruce Lehman

BRUCE LEHMAN

*Commissioner of Patents and Trademarks*

*Attest:*

*Attesting Officer*